US010933457B2

(12) United States Patent
Ito

(10) Patent No.: US 10,933,457 B2
(45) Date of Patent: Mar. 2, 2021

(54) PRESSING MACHINE AND A METHOD FOR MANUFACTURING A PRESS-FORMED PRODUCT

(71) Applicant: NIPPON STEEL & SUMITOMO METAL CORPORATION, Tokyo (JP)

(72) Inventor: Yasuhiro Ito, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 207 days.

(21) Appl. No.: 16/068,705

(22) PCT Filed: Jan. 25, 2017

(86) PCT No.: PCT/JP2017/002576

§ 371 (c)(1),
(2) Date: Jul. 9, 2018

(87) PCT Pub. No.: WO2017/131042

PCT Pub. Date: Aug. 3, 2017

(65) Prior Publication Data

US 2019/0015887 A1 Jan. 17, 2019

(30) Foreign Application Priority Data

Jan. 26, 2016 (JP) ..... JP2016-011980

(51) Int. Cl.
*B21D 22/26* (2006.01)
*B21D 24/00* (2006.01)

(52) U.S. Cl.
CPC ..... *B21D 22/26* (2013.01); *B21D 24/00* (2013.01)

(58) Field of Classification Search
CPC ..... B21D 22/02; B21D 22/06; B21D 22/20; B21D 22/21; B21D 22/26; B21D 22/30; B21D 53/88; B21D 24/00
See application file for complete search history.

(56) References Cited

U.S. PATENT DOCUMENTS 2,166,226 A * 7/1939 Vehko ..... B21D 22/26 29/6.1
3,252,315 A * 5/1966 Muench ..... B21D 53/32 72/328

(Continued)

FOREIGN PATENT DOCUMENTS

CN 104023868 9/2014
FR 3005880 11/2014

(Continued)

OTHER PUBLICATIONS

Translation; Yamaguchi et al., JP 2015-150601 A, Aug. 24, 2015.*

*Primary Examiner* — Edward T Tolan
(74) *Attorney, Agent, or Firm* — Clark & Brody LP

(57) ABSTRACT

A method for manufacturing a press-formed product includes a first step and a second step. In the first step, a concavity is press formed in a blank by use of a punch and a first die. The punch has a shape corresponding to the shape of the entire press-formed product. The first die has a shape corresponding to at least the shape of the concavity. In the second step, a vertical wall and an edge portion are press formed in the blank by use of the punch and a second die. The second die is located adjacent to the first die. The second die has a shape corresponding to at least the shape of the vertical wall and the edge portion. The first step is completed after the second step is completed. The method allows production of a press-formed product which is excellent in fatigue resistance.

12 Claims, 14 Drawing Sheets

(56) References Cited

U.S. PATENT DOCUMENTS

| | | | | |
|---|---|---|---|---|
| 5,187,966 | A * | 2/1993 | Seconde | B21D 22/26 72/329 |
| 5,924,188 | A * | 7/1999 | Tokunou | B21D 51/10 29/603.12 |
| 8,402,804 | B2 * | 3/2013 | Nakao | B21D 22/06 72/347 |
| 8,429,946 | B2 * | 4/2013 | Maeda | B21D 22/02 72/350 |
| 2006/0236741 | A1 * | 10/2006 | Saitou | B21D 53/26 72/348 |
| 2009/0272171 | A1 * | 11/2009 | Golovashchenko | G06F 30/23 72/348 |
| 2015/0024234 | A1 * | 1/2015 | Yamano | C22C 38/06 428/603 |
| 2015/0367397 | A1 * | 12/2015 | Uchiyama | B21D 22/26 72/379.2 |
| 2016/0332205 | A1 * | 11/2016 | Nakazawa | B21D 22/26 |
| 2017/0333972 | A1 * | 11/2017 | Nishimura | B21D 47/00 |
| 2018/0021831 | A1 * | 1/2018 | Ageba | B21D 22/02 72/379.2 |
| 2018/0264535 | A1 * | 9/2018 | Otsuka | B21D 35/005 |

FOREIGN PATENT DOCUMENTS

| | | |
|---|---|---|
| JP | 2007-144507 | 6/2007 |
| JP | 2014-217870 | 11/2014 |
| JP | 2015-150601 | 8/2015 |
| KR | 10-2010-0107771 | 10/2010 |
| RU | 2353457 | 4/2009 |

* cited by examiner

PRESSING MACHINE AND A METHOD FOR MANUFACTURING A PRESS-FORMED PRODUCT

TECHNICAL FIELD

The present invention relates to a pressing machine and a method for manufacturing a press-formed product (for example, an automobile lower arm) from a material metal plate.

BACKGROUND ART

In an automobile, a wheel is fastened to a vehicle body via a suspension. A lower arm is one of the components of the suspension. One end of the automobile lower arm (which will hereinafter be referred to simply as a "lower arm") is fastened to the vehicle body via the frame (which is suspension member in particular) of the suspension. The other end of the lower arm is fastened to the wheel.

FIG. 1 shows an example of a lower arm. A press-formed product 1 shown in FIG. 1 includes a body 2 and a projection 3. The body 2 is L-shaped or bow-shaped. One end portion (which will hereinafter be referred to as a first end portion) 2*a* of the body 2 is an end portion to be fastened to a vehicle body. The other end portion (which will hereinafter be referred to as a second end portion) 2*b* of the body 2 is an end portion to be fastened to a vehicle wheel. In FIG. 1, the end to be fastened to a vehicle wheel is indicated by "WH", and the end to be fastened to a vehicle body is indicated by "B".

The projection 3 projects outward with respect to the curve of the body 2. In FIG. 1, the projection 3 is located substantially in the middle of the body 2 with respect to the longitudinal direction (in other words, substantially on the middle point between the first end portion 2*a* and the second end portion 2*b*). The projection 3 is also to be fastened to a vehicle body.

Both the body 2 and the projection 3 have a groove-like sectional shape. The body 2 and the projection 3 each have a top board 4, and two vertical walls, that is, any two of the vertical walls 5*a*, 5*b* and 5*c*. The vertical wall 5*a* extends between the first end portion 2*a* of the body 2 and the second end portion 2*b* of the body 2. The vertical wall 5*b* extends between the first end portion 2*a* of the body 2 and the projection 3. The vertical wall 5*c* extends between the second end portion 2*b* of the body 2 and the projection 3. In the following description, a vertical wall means the vertical wall 5*a* in FIG. 1, and the vertical wall is denoted by a reference number 5. The vertical wall 5, as shown in FIG. 1, curves toward the projection 3 (which will be also referred to "curves inward"). The top board 4 connects to the vertical wall 5 via an edge portion 6. The edge portion 6 curves toward the top board 4. The top board 4 includes a brim 7 and a concavity 8. The brim 7 borders on the edge portion 6. The concavity 8 is along the brim 7. The concavity 8 includes a bottom face 8*b* and an inner wall 8*c*. The bottom face 8*b* of the concavity 8 has a peripheral portion 8*a*.

In FIG. 1, the concavity 8 is formed in the surface of the top board 4 of the body 2 and extends close to the projection 3, the first end portion 2*a* and the second end portion 2*b*.

The press-formed product 1 having the shape is formed by pressing a material metal plate (blank). Conventional technology relating to press forming is described in the following document.

Japanese Patent Application Publication No. 2007-144507 (Patent Literature 1) discloses a manufacturing method of a press-formed product that is excellent in shape fixability. When a vertical wall of a press-formed product is formed, the vertical wall is subjected to bending and is apt to warp due to its restoration behavior (that is, springback is apt to occur). In order to avoid the warp, Patent Literature 1 suggests forming a corrugated vertical wall. Patent Literature 1 states that this suppresses springback of the vertical wall.

CITATION LIST

Patent Literature

Patent Literature 1: Japanese Patent Application Publication 2007-144507

SUMMARY OF INVENTION

Technical Problems

When the manufacturing method disclosed in Patent Literature 1 is applied to production of a lower arm or any other undercarriage part (suspension part) of an automobile, some properties (including fatigue resistance) of the formed product may be low. While an automobile is running, loads due to vibration are repeatedly applied to the undercarriage parts of the automobile. Therefore, undercarriage parts are especially required to have high fatigue resistance.

FIGS. 2A to 2C are sectional views showing a conventional production process of a press-formed product to be used as a lower arm. A production process of the press-formed product 1 shown in FIG. 1 will be described below. FIG. 2A shows a stage of the production process before press forming. FIG. 2B shows a stage of the production process in the middle of press forming. FIG. 2C shows a stage of the production process on completion of press forming.

In order to produce the press-formed product 1 shown in FIG. 1, as shown in FIG. 2A, a first die 101 and a second die 102 are used as upper dies, and a punch 103 facing the upper dies is used a lower die. The first die 101 and the second die 102 are located under an upper holder 104. The punch 103 is supported by a lower holder 105. The upper holder 104 is fastened to a slide (not shown).

First, as shown in FIG. 2A, a blank S, which is, for example, a metal plate, is placed in a specified position of the punch 103. The blank S has a concavity 106, which was preliminarily formed by press forming. The concavity of the blank S is in the same shape as the shape of a concavity of a finally produced press-formed product. Thereafter, the slide moves down, and accordingly the first die 101 and the second die 102 move down.

Next, as shown in FIG. 2B, the concavity 106 of the blank S is pinched between the first die 101 and the punch 103. Thereafter, as shown in FIG. 2C, the slide further moves down, and press forming by the second die 102 and the punch 103 is completed. Thus, while the recess 106 is caught between the first die 101 and the punch 103, a vertical wall 107 is formed by the second die 102 and the punch 103. Then, a press-formed product 100 is obtained.

FIG. 3 is an enlarged view of a portion of the press-formed product around the edge portion at the stage shown in FIG. 2C. When the second die 102 reaches a bottom dead point for forming, the back side (the side near the punch 103 in FIG. 3) of the edge portion 108 of the press-formed product 100 is subjected to a compressive stress. When the first 101 and the second die 102 move away to release the press-formed product 100, resilience of the press-formed product 100 acts in the direction indicated by an arrow in FIG. 3, and the press-formed product 100 is returning to the shape before forming. (This phenomenon will hereinafter be referred to as springback.) When the amount of displacement by the resilience (which will hereinafter be referred to as a springback amount) is large, the back side of the edge portion 108 of the press-formed product 100 becomes subjected to a tensile stress rather than the compressive stress, and the tensile stress remains therein. (The remaining tensile stress will hereinafter be referred to as a residual tensile stress.) The press-formed product with the residual tensile stress is likely to have cracks in the part having the residual tensile stress when loads are repeatedly applied thereto. In short, when a press-formed product has a residual tensile stress, its fatigue resistance becomes lower. Especially in a case of a lower arm with a vertical wall like the inward curving vertical wall 5 shown in FIG. 1, the fatigue resistance is more likely to lower. The reason is as follows. The inward curving vertical wall 5 is formed by stretch flanging, and therefore, when the upper dies 101 and 102 are in the respective bottom dead points for forming, the back side (the inner side in the section) of the edge portion 6 is more apt to be subjected to a compressive stress, and the springback amount becomes larger.

When the manufacturing method disclosed in Patent Literature 1 is applied to production of a press-formed product such as a lower arm or the like, the residual stress in the edge portion is not decreased enough. Thus, the manufacturing method disclosed in Patent Literature 1 is not enough to suppress springback that leads to a decrease of the press-formed product in fatigue resistance.

Also, the manufacturing method disclosed in Patent Literature 1 is directed to parts having certain sectional shapes. Therefore, even when the manufacturing method is applied to production of a lower arm or another part including a top board with a concavity, and a vertical wall (edge portion) curving with respect to the longitudinal direction of the part, the formed product will not necessarily have excellent fatigue resistance.

The present invention has been made in view of the circumstances. An object of the present invention is to provide a pressing machine and a method for manufacturing a press-formed product with suppressing a decrease in fatigue resistance.

Solutions to Problem

A pressing machine according to an embodiment of the present invention includes a punch, a first die and a second die. The punch includes a top face, a side face, and a punch shoulder connecting the top face and the side face. The punch shoulder curves toward the top face. The top face has a concavity. The first die is located to face the concavity of the punch. The first die has a convexity having a shape corresponding to the shape of the concavity. A convexity having a shape corresponding to the shape of the concavity means a convexity having a shape which is concavo-convexly reversed to the shape of the concavity. To be exact, the convexity is smaller than the concavity by the thickness of a blank. The second die is located adjacent to the first die. The second die has a recess having a shape corresponding to the shape of the punch shoulder and the side face of the punch. A recess having a shape corresponding to the shape of the punch shoulder and the side face of the punch means a recess having a shape which is concavo-convexly reversed to the shape of the punch shoulder and the side face of the punch. In press forming, after the second die reaches a bottom dead point for forming, the first die reaches a bottom dead point for forming. To this end, the pressing machine controls motions of the first die and the second die mechanically or electrically.

For mechanical control of the dies, the pressing machine further includes an upper holder located above the first die and the second die, a first pressing member located between the upper holder and the first die, and a second pressing member located between the upper holder and the second die. An edge of the second die which is extended from the recess and is adjacent to the first die is positioned lower than an edge of the first die which is extended from the convexity and is adjacent to the second die. Accordingly, in press forming, the second die reaches the bottom dead point for forming, and thereafter, the first die reaches the bottom dead point for forming.

Further, a part of the first die may be positioned between the upper holder and the second pressing member. In this case, in the pressing machine, the upper holder is located above the first die, the first pressing member is located between the upper holder and the first die, the second pressing member is located between the first die and the second die. The edge of the second die which is extended from the recess and is adjacent to the first die is positioned lower than the edge of the first die which is extended from the convexity and is adjacent to the second die. Accordingly, during press forming, the second die reaches the bottom dead point for forming, and thereafter, the first die reaches the bottom dead point for forming. The pressure applied by the first pressing member is greater than the pressure applied by the second pressing member. If the pressure applied by the second pressing member is greater than the pressure applied by the first pressure, press forming by the first die will be impossible.

For electrical control of the dies, the pressing machine further includes a control unit controlling motions of the first die and the second die. The control unit controls motions of the first die and the second die such that the first die reaches the bottom dead point for forming after the second die reaches the bottom dead point for forming. Accordingly, in press forming, the second die reaches the bottom dead point for forming, and thereafter, the first die reaches the bottom dead point for forming.

A pressing machine according to an embodiment of the present invention includes a punch, a first die, a second die and a third die. The punch includes a top face, a side face, and a punch shoulder connecting the top face and the side face. The punch shoulder curves toward the top face. The top face has a concavity with a bottom face and an inner wall. The first die is located to face at least the inner wall of the concavity of the punch. The first die has a projecting portion having a shape corresponding to the shape of the inner wall of the concavity of the punch. A projecting portion having a shape corresponding to the shape of the inner wall of the concavity means a projecting portion having a shape which is concavo-convexly reversed to the shape of the inner wall of the concavity. The second die is located adjacent to the first die. The second die includes a recess having a shape corresponding to the shape of the punch shoulder and the side face of the punch. The third die is located adjacent to the first die to be positioned across from the second die with the first die in between. In press forming, after the third die reaches a bottom dead point for forming, the second die reaches a bottom dead point for forming. Further, after the second die reaches the bottom dead point for forming, the first die reaches a bottom dead point for forming. To this end, the pressing machine controls motions of the first die, the second die and the third die mechanically or electrically.

For mechanical control of the dies, the pressing machine further includes an upper holder, a first pressing member, a second pressing member and a third pressing member. The upper holder is located above the first die, the second die and the third die. The first pressing member is located between the upper holder and the first die. The second pressing member is located between the upper holder and the second die. The third pressing member is located between the upper holder and the third die. An edge of the third die which is adjacent to the first die and near the punch is positioned lower than an edge of the second die which is extended from the recess and is adjacent to the first die. The edge of the second die which is extended from the recess and is adjacent to the first die is positioned lower than an edge of the first die which is extended from the projecting portion and is adjacent to the second die. Accordingly, in press forming, after the third die reaches the bottom dead point for forming, the second die reaches the bottom dead point for forming. After the second die reaches the bottom dead point for forming, the first die reaches the bottom dead point for forming.

Further, a part of the first die may be positioned between the upper holder and at least one of the second pressing member and the third pressing member. In this case, in the pressing machine, the upper holder is located above the first die and the second die, the first pressing member is located between the upper holder and the first die, the second pressing member is located above the second die, and the third pressing member is located above the third die. At least one of the second pressing member and the third pressing member is located under the first die. The edge of the third die which is adjacent to the first die and near the punch is positioned lower than the edge of the second die which is extended from the recess and is adjacent to the first die. The edge of the second die which is extended from the recess and is adjacent to the first die is positioned lower than the edge of the first die which is extended from the projecting portion and is adjacent to the second die. Accordingly, in press forming, the third die, the second die and the first die reach their respective bottom dead points for forming in this order. The pressure applied by the first pressing member is greater than the total pressure applied by the second pressing member and the third pressing member which are located under the first die. If the total pressure applied by the second pressing member and the third pressing member which are located under the first die is greater than the pressure applied by the first pressing member, press forming by the first die will be impossible.

For electrical control of the dies, the pressing machine further includes a control unit controlling motions of the first die, the second die and the third die. The control unit controls the first die, the second die and the third die such that the second die reaches the bottom dead point for forming after the third die reaches the bottom dead point for forming and that the first die reaches the bottom dead point for forming thereafter. Accordingly, in press forming, after the third die reaches the bottom dead point for forming, the second die reaches the bottom dead point for forming. After the second die reaches the bottom dead point for forming, the first die reaches the bottom dead point for forming.

A method for manufacturing a press-formed product according to an embodiment of the present invention includes a first step and a second step. The press-formed product includes a top board, a vertical wall, and an edge portion connecting the top board and the vertical wall. The edge portion curves toward the top board. The top board has a concavity. In the first step, the concavity is press formed in a blank by use of a punch and a first die. The punch has a shape corresponding to the shape of the entire press-formed product. The first die has a shape corresponding to at least the shape of the concavity. A shape corresponding to the shape of the concavity means a convexity which is concavo-convexly reversed to the concavity. The concavity of the top board is formed by the convexity of the first die. In the second step, the vertical wall and the edge portion are press formed in the blank by use of the punch and a second die. The second die is located adjacent to the first die. The second die has a shape corresponding to at least the shape of the vertical wall and the edge portion. A shape corresponding to the shape of the vertical wall and the edge portion means a recess along the shape of the vertical wall and the edge portion. The first step is completed after the second step is completed.

A method for manufacturing a press-formed product according to an embodiment of the present invention includes a first step and a second step. The press-formed product includes a top board, a vertical wall, and an edge portion connecting the top board and the vertical wall. The edge portion curves toward the top board. The top board has a concavity with a bottom face and an inner wall. In the first step, at least the inner wall of the concavity is press formed in a blank by use of a punch and a first die. The punch has a shape corresponding to the shape of the entire press-formed product. The first die has a shape corresponding to at least the shape of the inner wall of the concavity. In the second step, the vertical wall and the edge portion are press formed in the blank by use of the punch and a second die. The second die is located adjacent to the first die. The second die has a shape corresponding to at least the shape of the vertical wall and the edge portion. In the first step and the second step, the blank is pinched between the punch and a third die. The third die has a shape corresponding to at least the shape of a part of the bottom face of the concavity of the press-formed product. The first step is completed after the second step is completed.

Advantageous Effect of Invention

The pressing machine and the manufacturing method according to the present invention suppress lowering of fatigue resistance of a press-formed product.

DESCRIPTION OF EMBODIMENTS

Figure 1:
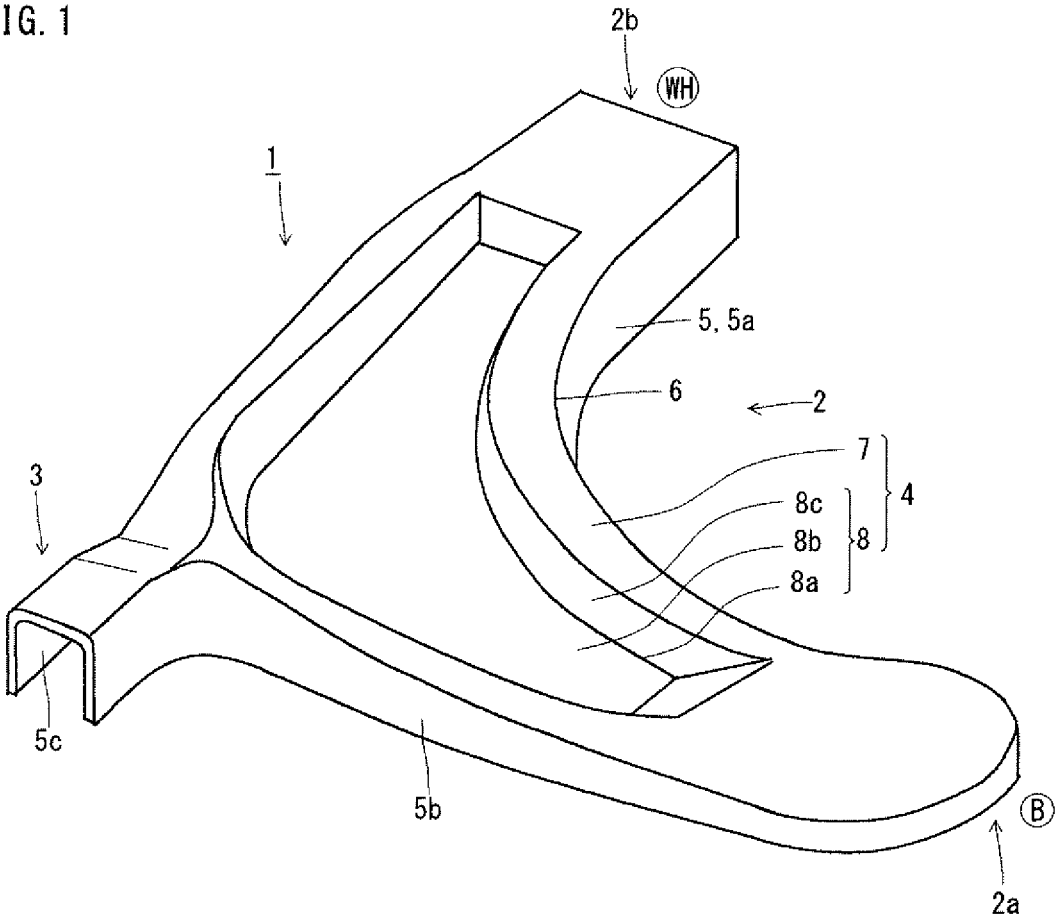
FIG. 1 is a perspective view of a press-formed product that is usable as a lower arm, showing a typical shape thereof.

A pressing machine according to an embodiment of the present invention includes a punch, a first die and a second die. The punch includes a top face, a side face, and a punch shoulder connecting the top face and the side face. The punch shoulder curves toward the top face. The top face has a concavity. The first die is located to face the concavity of the punch. The first die has a convexity having a shape corresponding to the shape of the concavity. The second die is located adjacent to the first die. The second die has a recess having a shape corresponding to the shape of the punch shoulder and the side face of the punch. In press forming, after the second die reaches a bottom dead point for forming, the first die reaches a bottom dead point for forming. To this end, motions of the first die and the second die are controlled mechanically or electrically.

For mechanical control of the dies, the pressing machine further includes an upper holder located above the first die and the second die, a first pressing member located between the upper holder and the first die, and a second pressing member located between the upper holder and the second die. An edge of the second die which is extended from the recess and is adjacent to the first die is positioned lower than an edge of the first die which is extended from the convexity and is adjacent to the second die. Accordingly, in press forming, the second die reaches the bottom dead point for forming, and thereafter, the first die reaches the bottom dead point for forming.

Further, a part of the first die may be positioned between the upper holder and the second pressing member. In this case, in the pressing machine, the upper holder is located above the first die, the first pressing member is located between the upper holder and the first die, the second pressing member is located between the first die and the second die. The edge of the second die which is extended from the recess and is adjacent to the first die is positioned lower than the edge of the first die which is extended from the convexity and is adjacent to the second die. Accordingly, in press forming, the second die reaches the bottom dead point for forming, and thereafter, the first die reaches the bottom dead point for forming. The pressure applied by the first pressing member is greater than the pressure applied by the second pressing member. If the pressure applied by the second pressing member is greater than the pressure applied by the first pressure, press forming by the first die will be impossible.

For electrical control of the dies, the pressing machine further includes a control unit controlling motions of the first die and the second die. The control unit controls motions of the first die and the second die such that the first die reaches the bottom dead point for forming after the second die reaches the bottom dead point for forming. Accordingly, in press forming, the second die reaches the bottom dead point for forming, and thereafter, the first die reaches the bottom dead point for forming.

In the pressing machine according to the embodiment, forming by the first die is completed after forming by the second die is completed. In other words, the first die reaches the bottom dead point for forming after the second die reaches the bottom dead point for forming. Accordingly, after the vertical wall of the press-formed product is formed, the concavity is formed. Thereby, while the first die processes the blank (workpiece), the blank is pulled into the concavity of the punch. In this regard, the material of the blank flows from the vertical wall into the concavity. Along with the flow of the material into the concavity, forces act on the back side of the edge portion in directions in which the material is pulled, and accordingly, the compressive stress decreases. Consequently, the springback amount of the vertical wall decreases, and the residual stress on the back side of the edge portion decreases as compared with a case where the blank is processed in a conventional pressing machine. Therefore, a decrease of the lower arm 1 in fatigue resistance can be suppressed.

For production of a press-formed product having a vertical wall only on one side in a sectional view along a line perpendicular to the longitudinal direction thereof, a pressing machine as described below can be used.

A pressing machine according to an embodiment includes a punch, a first die, a second die and a third die. The punch includes a top face, a side face, and a punch shoulder connecting the top face and the side face. The punch shoulder curves toward the top face. The top face has a concavity with a bottom face and an inner wall. The first die is located to face at least the inner wall of the concavity of the punch. The first die has a projecting portion having a shape corresponding to the shape of the inner wall of the concavity. The second die is located adjacent to the first die.

The second die includes a recess having a shape corresponding to the shape of the punch shoulder and the side face of the punch. The third die is located adjacent to the first die to be positioned across from the second die with the first die in between. In press forming, after the third die reaches a bottom dead point for forming, the second die reaches a bottom dead point for forming. Further, after the second die reaches the bottom dead point for forming, the first die reaches a bottom dead point for forming. To this end, motions of the first die, the second die and the third die are controlled mechanically or electrically.

For mechanical control of the dies, the pressing machine further includes an upper holder located above the first die and the second die, a first pressing member located between the upper holder and the first die, a second pressing member located between the upper holder and the second die, and a third pressing member located between the upper holder and the third die. An edge of the third die which is adjacent to the first die and near the punch is positioned lower than an edge of the second die which is extended from the recess and is adjacent to the first die. The edge of the second die which is extended from the recess and is adjacent to the first die is positioned lower than an edge of the first die which is extended from the projecting portion and is adjacent to the second die. Accordingly, in press forming, the third die, the second die and the first die reach their respective bottom dead points for forming in this order.

Further, a part of the first die may be positioned between the upper holder and at least one of the second pressing member and the third pressing member. In this case, in the pressing machine, the upper holder is located above the first die and the second die, the first pressing member is located between the upper holder and the first die, the second pressing member is located above the second die, and the third pressing member is located above the third die. At least one of the second pressing member and the third pressing member is located under the first die. The edge of the third die which is adjacent to the first die and near the punch is positioned lower than the edge of the second die which is extended from the recess and is adjacent to the first die. The edge of the second die which is extended from the recess and is adjacent to the first die is positioned lower than the edge of the first die which is extended from the projecting portion and is adjacent to the second die. Accordingly, in press forming, the third die, the second die and the first die reach their respective bottom dead points for forming in this order. The pressure applied by the first pressing member is greater than the total pressure applied by the second pressing member and the third pressing member which are located under the first die. If the total pressure applied by the second pressing member and the third pressing member which are located under the first die is greater than the pressure applied by the first pressing member, press forming by the first die will be impossible.

For electrical control of the dies, the pressing machine further includes a control unit controlling motions of the first die, the second die and the third die. The control unit controls the first die, the second die and the third die such that the third die, the second die and the third die reach their respective bottom dead point for forming in this order. The third die stays in the bottom dead point for forming after it has reached the bottom dead point for forming until the first die reaches the bottom dead point for forming. The second die stays in the bottom dead point for forming after it has reached the bottom dead point for forming until the first die reaches the bottom dead point for forming.

In the pressing machine, in a section of the punch shoulder, the radius of curvature of the punch shoulder is preferably not less than 2 mm and not more than 10 mm. The maximum curvature radius of the punch shoulder is preferably not less than 100 mm and not more than 250 mm. The width of a portion between the punch shoulder and the concavity of the punch is preferably not more than 15 mm. The depth of the concavity of the punch is preferably not less than 3 mm and not more than 20 mm.

A method for manufacturing a press-formed product according to an embodiment includes a first step and a second step. The press-formed product includes a top board, a vertical wall, and an edge portion connecting the top board and the vertical wall. The edge portion curves toward the top board, and the top board has a concavity. In the first step, the concavity is press formed in a blank by use of a punch and a first die. The punch has a shape corresponding to the shape of the entire press-formed product. The first die has a shape corresponding to at least the shape of the concavity. A shape corresponding to the shape of the concavity means a convexity which is concavo-convexly reversed to the concavity. The concavity of the top face is formed by the convexity of the first die. In the second step, the vertical wall and the edge portion are press formed in the blank by use of the punch and a second die. The second die is located adjacent to the first die. The second die has a shape corresponding to the shape of the vertical wall and the edge portion. A shape corresponding to the shape of the vertical wall and the edge portion means a recess along the shape of the vertical wall and the edge portion. The first step is completed after the second step is completed.

For production of a press-formed product having a vertical wall only on one side in a sectional view along a line perpendicular to the longitudinal direction thereof, a manufacturing method as described below can be used.

A method for manufacturing a press-formed product according to an embodiment includes a first step and a second step. The press-formed product includes a top board, a vertical wall, and an edge portion connecting the top board and the vertical wall. The edge portion curves toward the top board. The top board has a concavity with a bottom face and an inner wall. In the first step, at least the inner wall of the concavity is press formed in a blank by use of a punch and a first die. The punch has a shape corresponding to the shape of the entire press-formed product. The first die has a shape corresponding to at least the shape of the inner wall of the concavity. In the second step, the vertical wall and the edge portion are press formed in the blank by use of the punch and a second die. The second die is located adjacent to the first die. The second die has a shape corresponding to at least the shape of the vertical wall and the edge portion. In the first step and the second step, the blank is pinched between the punch and a third die. The third die has a shape corresponding to at least the shape of a part of the bottom face of the concavity of the press-formed product. The first step is completed after the second step is completed.

In either of the manufacturing methods, before the first step, a blank having a depression in an area corresponding to the concavity, the depression being shallower than the concavity, may be prepared as the blank.

In either of the manufacturing methods, in a section of the edge portion, the radius of curvature of the edge portion is preferably not less than 2 mm and not more than 10 mm. The height of the vertical wall is preferably not less than 17 mm and not more than 35 mm. The maximum curvature radius of the edge portion is preferably not less than 100 mm and not more than 250 mm. The width of a portion of the top board between the edge portion and the concavity is preferably not more than 15 mm. The depth of the concavity of the top board is preferably not less than 3 mm and not more than 20 mm.

The above-described method is suited for production of an undercarriage part of an automobile.

Some embodiments of the present invention will hereinafter be described in reference to the drawings.

First Embodiment

[Press-Formed Product]

A press-formed product to be produced by a manufacturing method according to a first embodiment will be described in reference to FIG. 1. The press-formed product 1 includes a vertical wall 5 and a top board 4. The vertical wall 5 extends from a first end portion 2*a* of a body 2 of the press-formed product 1 to a second end portion 2*b* of the body 2, and curves inward. The top board 4 connects to the vertical wall 5 via an edge portion 6. In the top board 4, a concavity 8 is formed along a brim 7 adjacent to the edge portion 6. The press-formed product 1 is to be used as a lower arm. In the following, production of the lower arm shown in FIG. 1 will be described as an example of production of a press-formed product.

[Pressing Machine]

A pressing machine used in the manufacturing method according to the first embodiment will be described in reference to FIG. 4.

Figure 4:
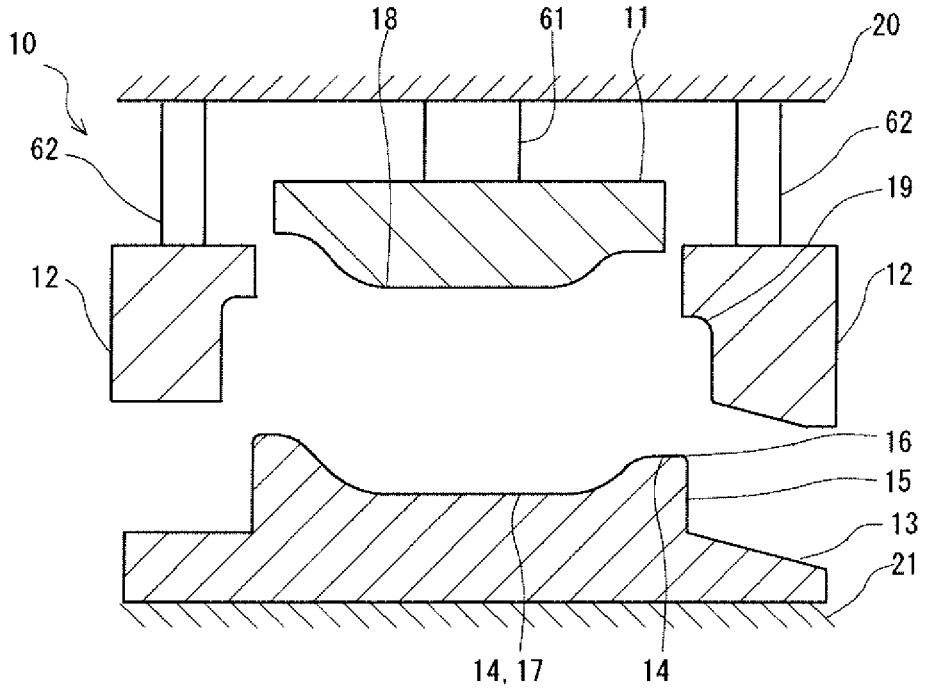
FIG. 4 is a sectional view of a pressing machine according to a first embodiment.

FIG. 4 is a sectional view of the pressing machine according to the first embodiment. The pressing machine 10 includes a punch 13 as a lower die and includes a first die 11 and a second die 12 as upper dies. The punch 13 has a shape corresponding to the shape of the entire lower arm 1 shown in FIG. 1. The punch 13 includes a top face 14, a side face 15 and a punch shoulder 16. The top face 14 includes a portion between a concavity 17 and the punch shoulder 16. The top face 14 has a shape corresponding to the shape of the top board 4 of the lower arm 1 shown in FIG. 1. Hence, the top board 14 has a concavity 17. The side face 15 has a shape corresponding to the shape of the vertical wall 5 of the lower arm 1. The punch shoulder 16 connects the top face 14 and the side face 15. The outline form of the punch shoulder 16 is a circular arc. The punch shoulder 16 has a shape corresponding to the shape of the edge portion 6 of the lower arm 1 shown in FIG. 1. The punch shoulder 16 curves toward the top face 14. Hence, the punch shoulder 16 is to form the inward curving (curving toward the top board 4) edge portion 6 of the lower arm 1.

The first die 11 faces the concavity 17 of the punch 13. The first die 11 has a convexity 18 having a shape corresponding to the concavity 17 of the punch 13. Specifically, the shape of the convexity 18 is concavo-convexly reversed to the shape of the concavity 17. To be more exact, the convexity 18 is smaller than the concavity 17 by the thickness of a blank S. Thus, the shape of the first die 11 corresponds to at least the shape of the concavity 8 of the lower arm 1 shown in FIG. 1.

The second die 12 is located adjacent to the first die 11. The second die 12 has a recess 19 having a shape corresponding to the shape of the punch shoulder 16 and the side face 15 of the punch 13. In other words, the shape of the recess 19 is concavo-convexly reversed to the shape of the punch shoulder 16 and the side face 15. To be more exact, the shape of the recess 19 is different from the shape of the punch shoulder 16 and the side face 15 by the thickness of the blank. Thus, the shape of the second die 12 corresponds to at least the shape of the vertical wall 5 and the edge portion 6 of the lower arm 1 shown in FIG. 1.

The first die 11 and the second die 12 are located under an upper holder 20. A first pressing member 61 is disposed between the first die 11 and the upper holder 20, and a second pressing member 62 is disposed between the second die 12 and the upper holder 20. The first pressing member 61 and the second pressing member 62 are hydraulic cylinders, gas cylinders, springs, rubber members or the like. The upper holder 20 is fastened to a slide (not shown). The punch 13 is fixed to a lower holder 21. The lower holder 21 is fastened to a bolster plate (not shown). When no load is applied to the first pressing member 61 and the second pressing member 62 (when the upper holder 20 is in an upper position), an edge of the second die 12 which is extended from the recess 19 and is adjacent to the first die 11 is positioned lower than an edge of the first die 11 which is extended from the convexity 18 and is adjacent to the second die 12. Accordingly, as the upper holder 20 is moving down, the second die 12 reaches a bottom dead point for forming, and thereafter, the first die 11 reaches a bottom dead point for forming.

The pressing machine 10 is not limited to the structure shown in FIG. 4. Modifications will be described below.

Figure 14:
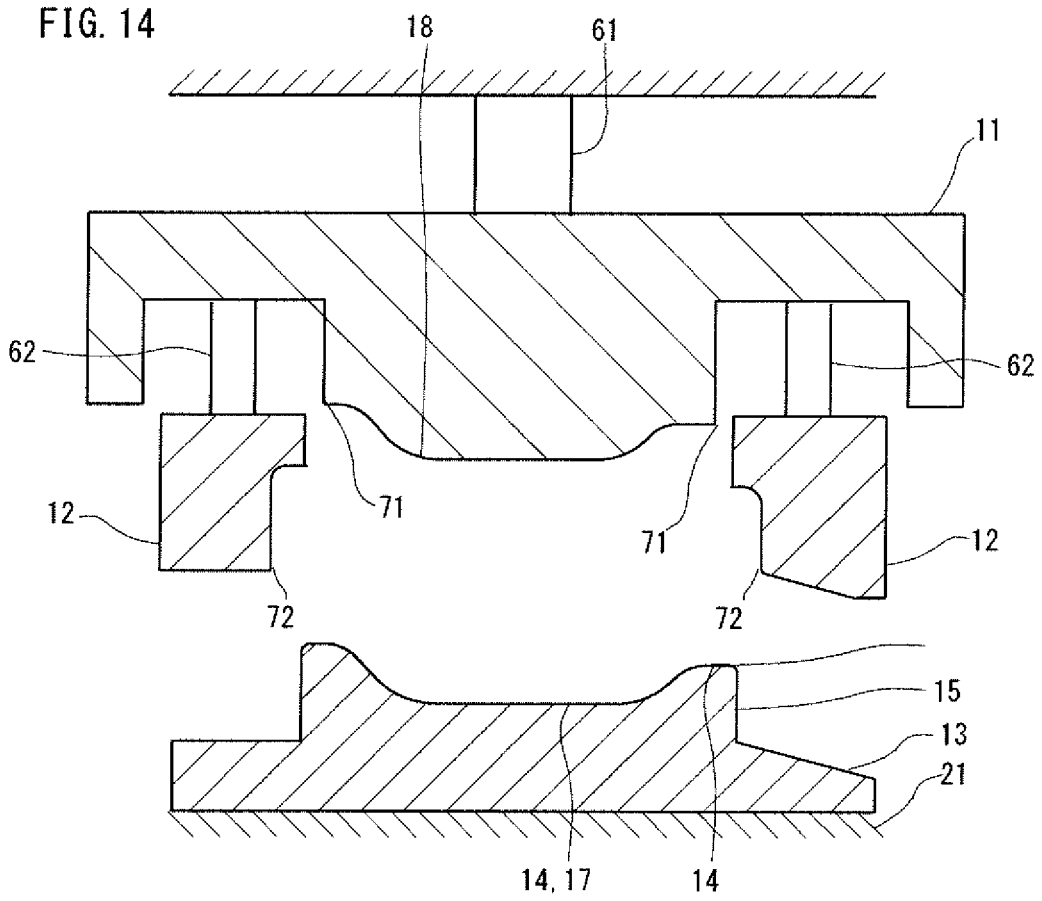
FIG. 14 is a sectional view of another modification of the pressing machine according to the first embodiment.

FIG. 14 is a sectional view of a modification of the pressing machine according to the first embodiment. The modified pressing machine differs from the pressing machine shown in FIG. 4 in the following points: the first die 11 is extended to lie over the second die 12; and the second pressing member 62 above the second die 12 is located between the first die 11 and the second die 12. The second die 12 is located adjacent to an edge of the first die 11 extended from the convexity 18, and located under the first die 11. In this modified pressing machine also, when no load is applied to the first pressing member 61 and the second pressing member 62 (when the upper holder 20 is in an upper position), the edge 72 of the second die 12 which is extended from the recess 19 and is adjacent to the first die 11 is positioned lower than the edge 71 of the first die 11 which is extended from the convexity 18 and is adjacent to the second die 12. Accordingly, as the upper holder 20 is moving down, the second die 12 reaches the bottom dead point for forming, and thereafter, the first die 11 reaches the bottom dead point for forming.

Another modification will be described. The pressing machine 10 is not limited to the structure shown in FIG. 4.

Figure 12:
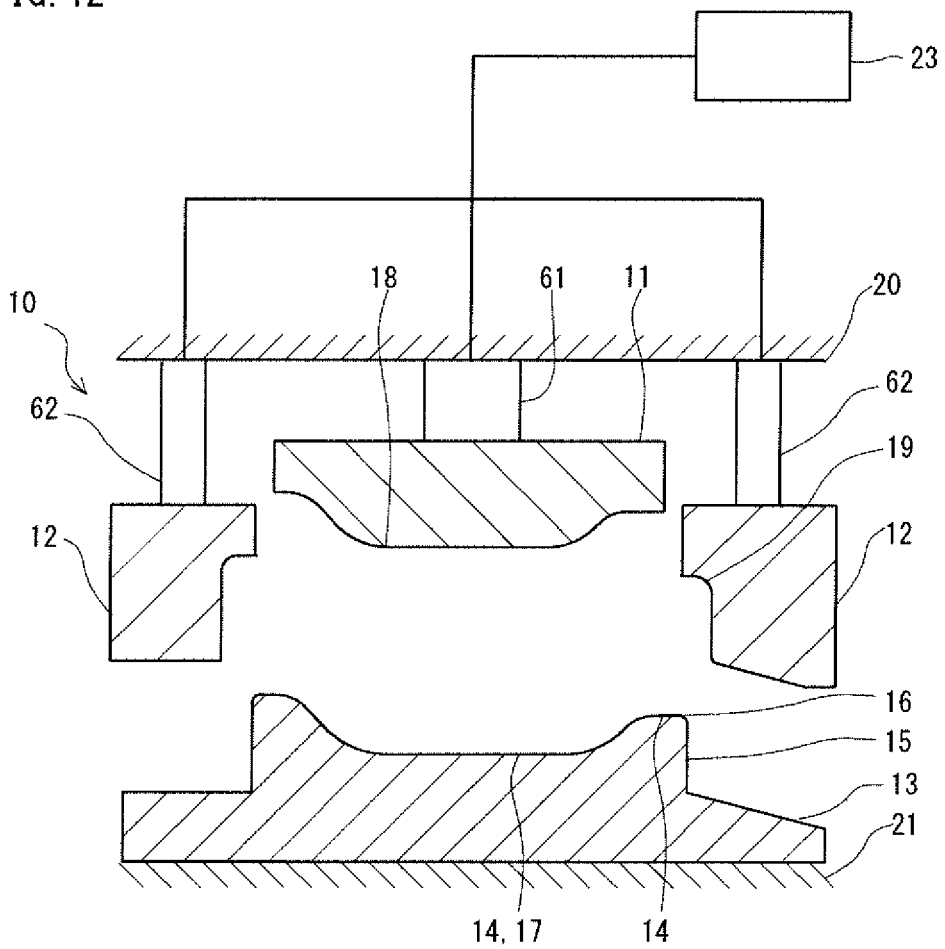
FIG. 12 is a sectional view of a modification of the pressing machine according to the first embodiment.

FIG. 12 is a sectional view of a modification of the pressing machine according to the first embodiment. For example, the first die 11 and the second die 12 may be fastened to different slides which are separately movable. In this case, the separately movable slides are the first pressing member 61 and the second pressing member 62. The pressing machine 10 further includes a control unit 23. The control unit 23 is a control computer which sends out commands to the first pressing member 61 and the second pressing member 62 to control motions of the first die 11 and the second die 12. The control unit 23 makes the second die 12 reach the bottom dead point for forming. Thereafter, the control unit 23 makes the first die 11 reach the bottom dead point for forming.

[Manufacturing Method]

A method for manufacturing the lower arm 1 shown in FIG. 1 by using the above-described pressing machine will hereinafter be described. A manufacturing method according to a first embodiment includes a preparation step, a blank placement step, a first step and a second step. The steps will be described below.

[Preparation Step]

In the preparation step, a blank made of a metal plate is prepared. The blank is obtained, for example, by blanking a metal plate. The metal plate is, for example, a plate of steel, aluminum, an aluminum alloy, or the like. In a case where the metal plate is a steel plate, the manufacturing method according to the first embodiment is especially effective when the steel plate has a thickness t of not less than 1.8 mm and not more than 6.0 mm. As the blank, such a self-build blank or alternatively a commercially available blank may be used.

[Blank Placement Step]

In the blank placement step, the blank prepared in the preparation step is placed between the first die 11 and the punch 13. In this regard, the outer part of the blank is positioned between the second die 12 and the punch 13. The outer part of the blank may be positioned within the space between the second die 12 and the punch 13 or alternatively may stick out of the space between the second die 12 and the punch 13.

Figure 2A:
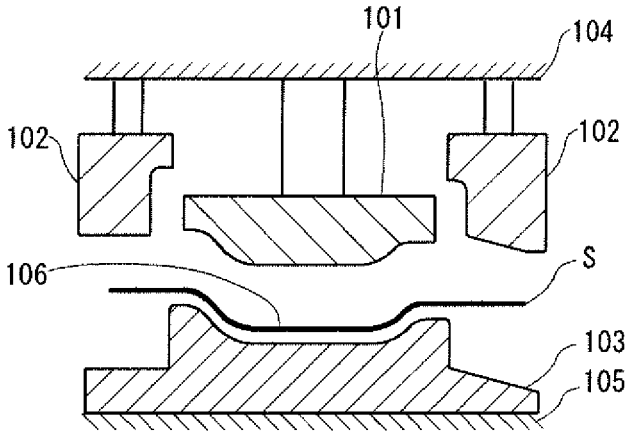
FIG. 2A is a view showing a stage of a conventional manufacturing method before press forming.
Figure 2B:
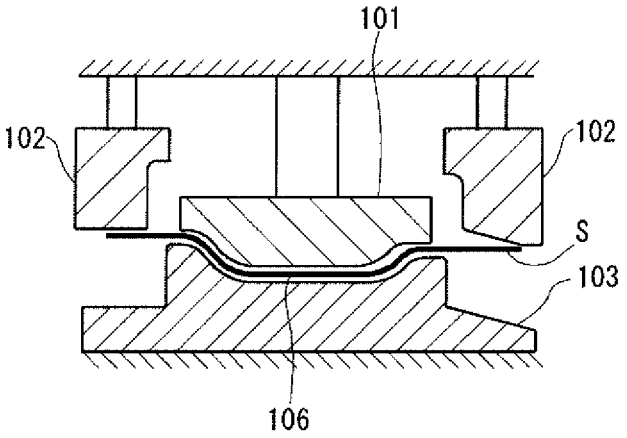
FIG. 2B FIG. 2B is a view showing a stage of the conventional manufacturing method in the middle of press forming.
Figure 2C:
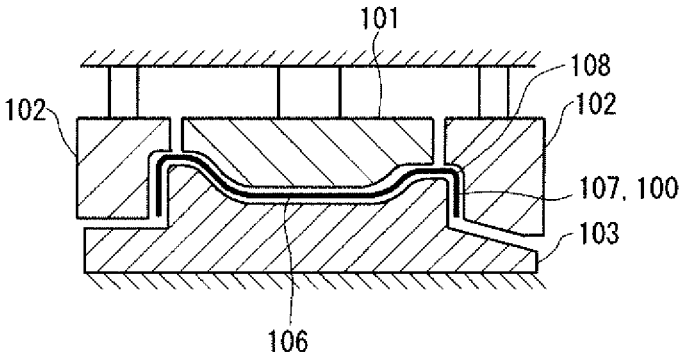
FIG. 2C is a view showing a stage of the conventional manufacturing method on completion of press forming.
Figure 3:
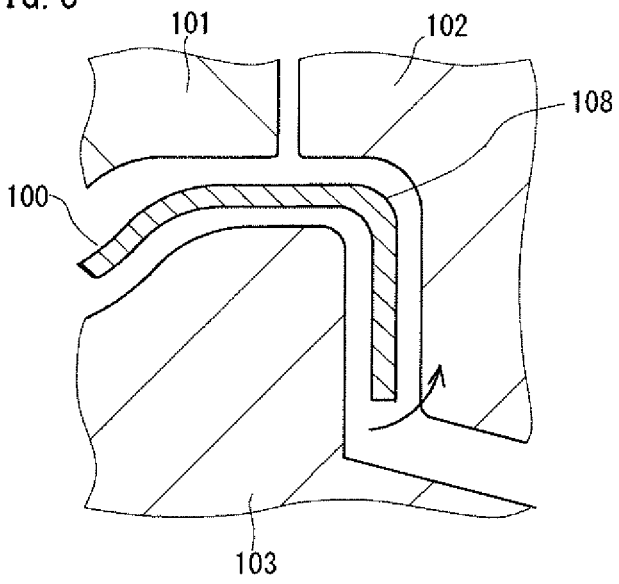
FIG. 3 is an enlarged view of a part of the press-formed product around the edge portion at the stage shown in FIG. 2C.

As described above, in a conventional manufacturing method of a lower arm, while the concavity 106 is pinched between the first die 101 and the punch 103, the vertical wall 107 is formed by the second die 102 (see FIGS. 2A to 2C). Specifically, when the vertical wall 107 is formed, the concavity 106 is pinched between the first die 101 and the punch 103. Therefore, the material does not flow into the concavity 106 easily during forming of the vertical wall 107. When a lower arm including a top board with a concavity and an inward curving vertical wall is produced by such a conventional manufacturing method, the produced lower arm is low in fatigue resistance.

The manufacturing method according to the first embodiment intends to suppress a decrease of a lower arm in fatigue resistance, and in the manufacturing method, press forming is performed such that forming by pressure applied by the first die is completed after forming by pressure applied by the second die is completed.

[First Step and Second Step]

Figure 5A:
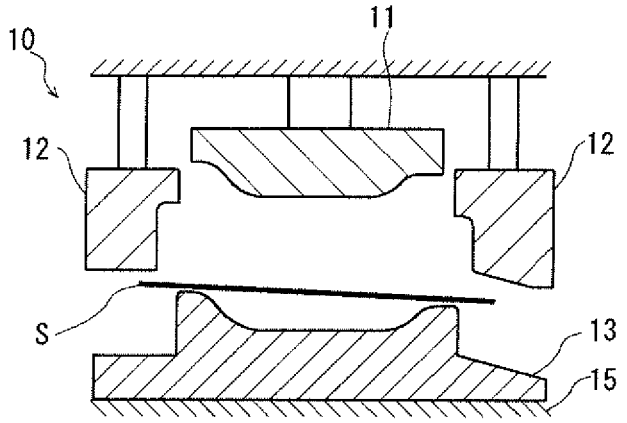
FIG. 5A is a view showing a stage before press forming in a first step and a second step according to a first embodiment.
Figure 5B:
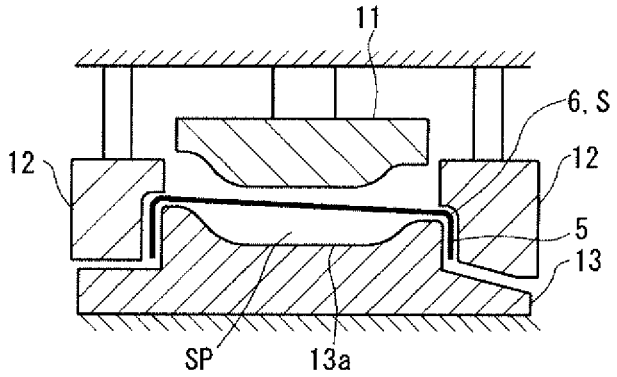
FIG. 5B is a view showing a stage during press forming of a press forming process according to the first embodiment.
Figure 5C:
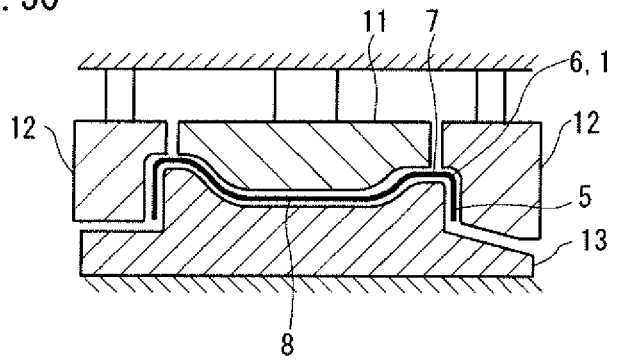
FIG. 5C is a view showing a stage on completion of press forming in the first step and the second step according to the first embodiment.

FIGS. 5A to 5C are sectional views showing an example of the first step and the second step of the manufacturing method according to the first embodiment for producing a press-formed product usable as a lower arm. FIG. 5A shows a stage before press forming in the first step and the second step of the manufacturing method according to the first embodiment. FIG. 5B shows a stage during press forming in the first step and the second step of the manufacturing method according to the first embodiment. FIG. 5C shows a stage on completion of press forming in the first step and the second step of the manufacturing method according to the first embodiment.

As shown in FIG. 5A, a blank S is placed in a predetermined position of the pressing machine 10. Thereafter, the slide (not shown) moves down, and thereby the vertical wall 5 is first formed by the second die 12 and the punch 13 (see FIG. 5B).

As shown in FIG. 5B, at the end of the processing of the blank S by the second die 12, the processing of the blank S by the first die 11 has not been completed. At this stage, accordingly, there is a space SP between the portion of the blank S to be formed into the concavity 8 of the lower arm 1 and the bottom face 13*a* of the punch 13. Then, the slide moves further down, and at the end, the concavity 8 is formed by the first die 11 (see FIG. 5C). With the forming of the concavity 8, the brim 7 is also formed.

When the blank S is processed by the first die 11, the blank S is pulled toward the bottom face 13*a* of the punch 13 because of the presence of the space SP. At the time, the material of the blank S flows from the vertical wall 5 into the concavity 8 (FIG. 5C). Along with the flow of the material into the concavity 8, force acts on the back side of the edge portion 6 in directions in which the material is pulled, and accordingly, the compressive stress decreases. Along with the decrease in compressive stress, the resilience of the vertical wall 5 decreases, and the springback amount of the vertical wall 5 after mold release decreases. When the springback amount decreases, the residual stress on the back side of the edge portion 6 continues to act in the direction of compression, or alternatively, even if the residual stress acts in the directions in which the material is pulled, the tensile stress is very small. Therefore, the residual tensile stress becomes smaller as compared with a press-formed product manufactured by a conventional method. Accordingly, a decrease of the lower arm 1 in fatigue resistance can be suppressed.

As shown in FIG. 5C, on completion of the processing of the blank S by the first die 11, the concavity 8 is formed, and the lower arm 1 as shown in FIG. 1 is obtained.

The parting line between the first die 11 and the second die 12 will be described below in reference to FIG. 6.

Figure 6:
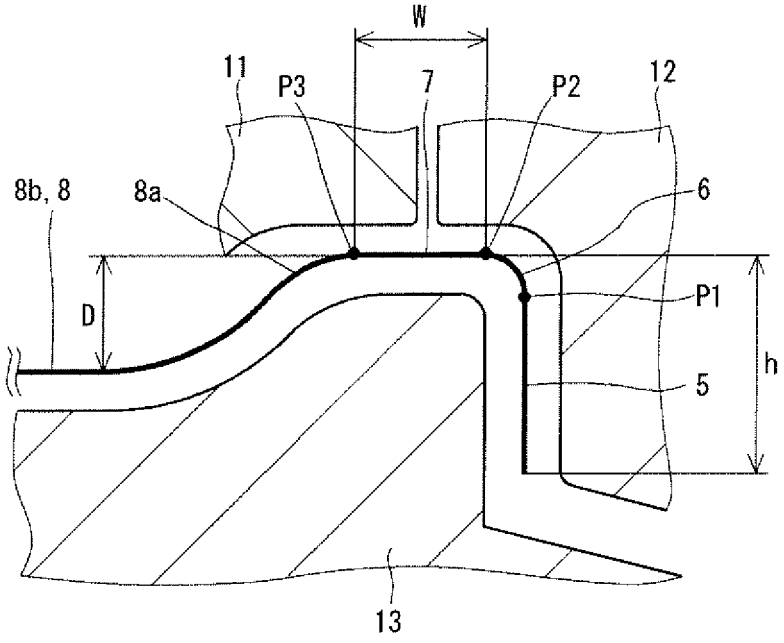
FIG. 6 is an enlarged sectional view of a part of a lower arm around the edge portion at the stage shown in FIG. 5C.

FIG. 6 is an enlarged sectional view of a part of the lower arm around the edge portion 6 shown in FIG. 5C. In the lower arm 1 according to the first embodiment, the edge portion 6 is a portion from a border P1 to a border P2 in FIG. 6. The border P1 is the border between the edge portion 6 and the vertical wall 5. The border P2 is the border between the edge portion 6 and the brim 7. The border P1 and the border P2 define the outline of the edge portion 6. The brim 7 is a portion from the border P2 to a border P3. The border P3 is the border between the brim 7 and the concavity 8. FIG. 6 shows a case where the peripheral portion 8*a* of the concavity 8 is in the shape of a circular arc. In this case, the border P3 is an edge of the peripheral portion 8*a*.

The parting line between the first die 11 and the second die 12 is preferably positioned between the border P2 and the border P3 for the reasons below. If the parting line is positioned at the outer side (on the side of the vertical wall 5) of the border P2, the edge of the first die 11 will be sharp. Then, the first die 11 will easily get broken. If the parting line between the first die 11 and the second die 12 is positioned at the inner side (on the side of the concavity 8) of the border P3, during forming of the concavity 8, the frictional resistance between the second die 12 and the punch 13 will be great. In that case, the material will not easily flow into the concavity 8 due to the great frictional resistance. Then, the edge of the second die 12 will be sharp, and the second die 12 will easily get broken.

Second Embodiment

In connection with the first embodiment, a case where the blank S is a flat plate has been described. However, the blank S is not necessarily a flat plate. For example, the blank S may be an intermediate product obtained by applying one or more preliminary press forming steps to a metal plate.

The second embodiment differs from the first embodiment in that the blank S prepared in the preparation step of the second embodiment has a depression. The manufacturing method according to the second embodiment has no other differences from the manufacturing method according to the first embodiment. In the following description of the second embodiment, content of the second embodiment overlapping the first embodiment will be omitted.

[Preparation Step]

In the preparation step of the second embodiment, a metal plate with a depression is prepared as the blank S. Before the first step and the second step, the depression is formed by press forming a material metal plate. In the second embodiment, the depression of the blank S is shallower than the concavity of the press-formed product. As will be described later, this is to make a space between the blank S and the bottom face of the punch and to permit the material to flow in the space during forming of the concavity of the press-formed product.

Figure 7A:
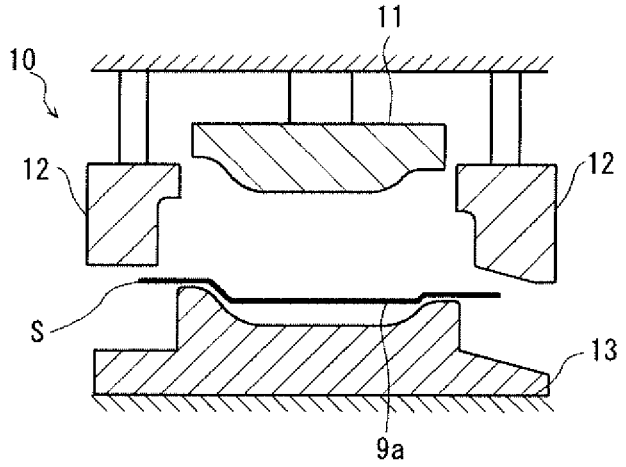
FIG. 7A is a view showing a stage before press forming in a first step and a second step according to a second embodiment.
Figure 7B:
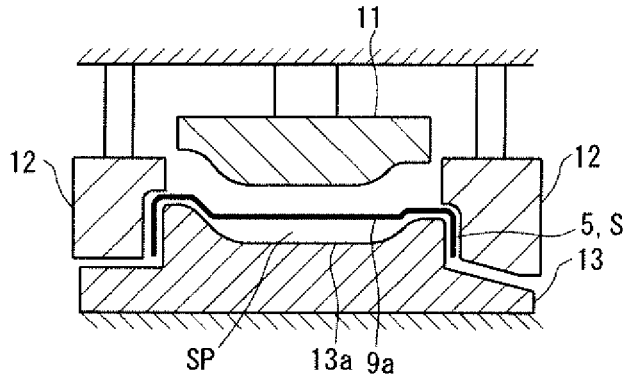
FIG. 7B is a view showing a stage during press forming in the first step and the second step according to the second embodiment.
Figure 7C:
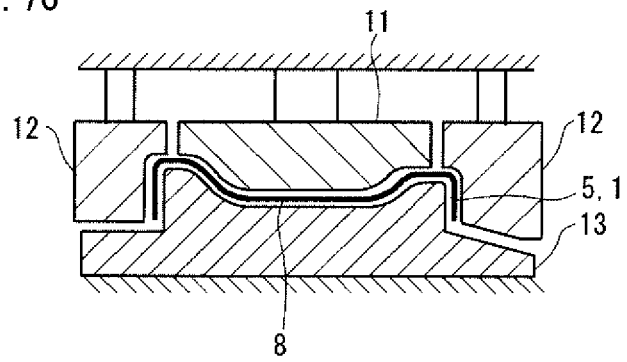
FIG. 7C is a view showing a stage on completion of press forming in the first step and the second step according to the second embodiment.

FIGS. 7A to 7C are sectional views showing an example of the first step and the second step of the manufacturing method according to the second embodiment for producing a press-formed product usable as a lower arm. FIG. 7A shows a stage before press forming in the first step and the second step of the manufacturing method according to the second embodiment. FIG. 7B shows a stage during press forming in the first step and the second step of the manufacturing method according to the second embodiment. FIG. 7C shows a stage on completion of press forming in the first step and the second step of the manufacturing method according to the second embodiment.

In the second embodiment, as shown in FIG. 7A, the blank S prepared in the preparation step has a depression 9*a*. The depression 9*a* is positioned in a part of the blank corresponding to the concavity 8 of the lower arm 1. The depth of the depression 9*a* is smaller than the depth of the concavity 8. The depression 9*a* is formed into the concavity 8 by the first die 11 and the punch 13. In this case, the amount of forming of the blank S by the first die 11 is small. Therefore, the produced lower arm 1 are unlikely to have cracking or any other defects in the concavity 8. In this case also, as shown in FIG. 7B, when forming by the second die 12 is completed, there is a space SP between the depression 9*a* of the blank S and the bottom face 13*a* of the punch 13. This is to permit the material to flow from the vertical wall 5 into the concavity 8 during processing of the blank S by the first die 11 (see FIG. 7C).

Figure 8:
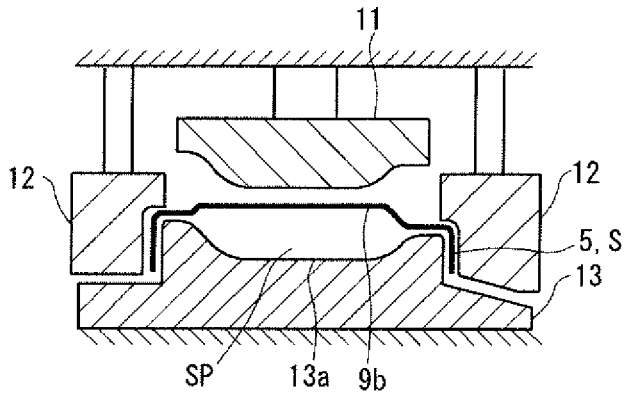
FIG. 8 is a sectional view showing an example of the first step and the second step according to the second embodiment when a blank different from the blank shown in FIGS. 7A to 7C is used.

FIG. 8 is a sectional view showing another example of the first step and the second step of the manufacturing method according to the second embodiment, where another blank different from the blank used in the case of FIGS. 7A and 7C is used. FIG. 8 shows a stage on completion of press forming by the second die. The blank S shown in FIG. 8 has a protuberance 9*b* instead of the depression 9*a*. The protuberance 9*b* is positioned in a part of the blank corresponding to the concavity 8 of the lower arm 1. The height of the protuberance 9*b* is smaller than the depth of the concavity 8. The protuberance 9*b* is formed into the concavity 8 by the first die 11 and the punch 13. In this case also, there is a space SP between the protuberance 9*b* of the blank S and the bottom face 13*a* of the punch 13. Accordingly, as in the case of using the blank with a depression 9*a*, the springback amount of the vertical wall 5 after mold release is small, and a decrease of the lower arm 1 in fatigue resistance can be suppressed. The depth of the depression 9*a* and the height of the protuberance 9*b* should be set out as appropriate according to the strength, the plate thickness and the ductility of the material.

Third Embodiment

The third embodiment is based on the first embodiment. The third embodiment differs from the first embodiment in that the press-formed product has a vertical wall only on one side. In order to produce the press-formed product, a third die is added to the pressing machine according to the first embodiment. The press-formed product to be produced by the pressing machine and the manufacturing method according to the third embodiment is, for example, a reinforcing member for a lower arm, a part of an automotive body frame, or the like. The following description of the third embodiment is of a case where the press-formed product is a reinforcing member for a lower arm (which will hereinafter be referred to simply as a "reinforcing member").

[Press-Formed Product]

A reinforcing member to be produced in the manufacturing method according to the third embodiment has only the vertical wall 5*a* of the lower arm 1 shown in FIG. 1. In other words, neither of the vertical walls 5*b* and 5*c* of the lower arm 1 shown in FIG. 1 is provided to the reinforcing member. The reinforcing member has no other differences from the lower arm 1 according to the first embodiment. Thus, the reinforcing member according to the third embodiment has an inward curving vertical wall and an inward curving edge portion as in the case with the lower arm shown in FIG. 1. The reinforcing member according to the third embodiment is, for example, fastened to the back side of the lower arm shown in FIG. 1. The reinforcing member is to reinforce a part of the lower arm shown in FIG. 1 around the curving edge portion 6. In a case where the reinforcing member is produced by a conventional manufacturing method, as in the case of the above-described lower arm, the produced reinforcing member is likely to decrease in fatigue resistance.

[Pressing Machine]

A pressing machine used in the manufacturing method according to the third embodiment will hereinafter be described in reference to FIG. 9.

Figure 9:
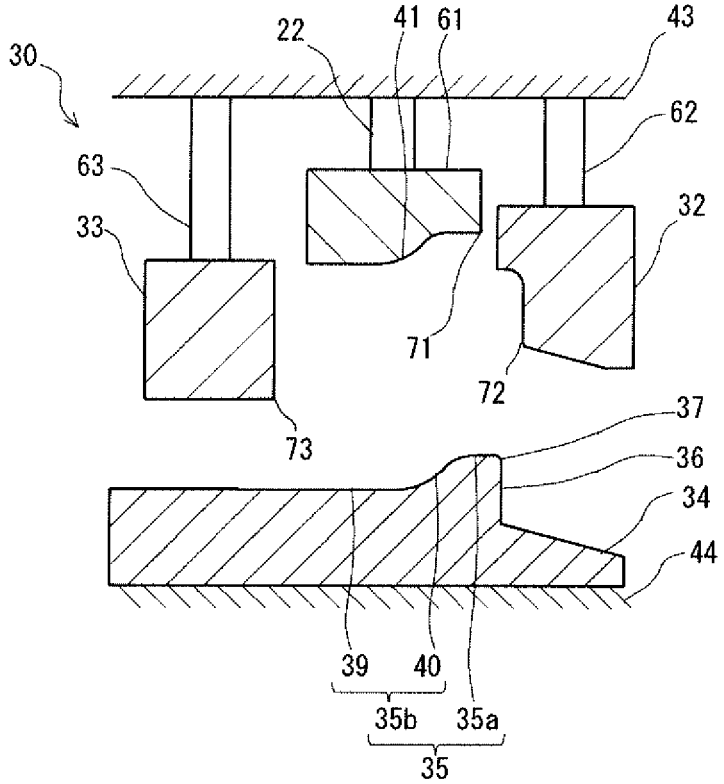
FIG. 9 is a sectional view of a pressing machine according to a third embodiment.

FIG. 9 is a sectional view of the pressing machine according to the third embodiment. The pressing machine 30 includes a punch 34 as a lower die, and includes a first die 31, a second die 32 and a third die 33 as upper dies. The punch 34 has a shape corresponding to the shape of the entire reinforcing member. The punch 34 includes a top face 35, a side face 36, and a punch shoulder 37. The top face 35 has a shape corresponding to the top board of the reinforcing member. The side face 36 has a shape corresponding to the vertical wall of the reinforcing member. The punch shoulder 37 connects the top face 35 and the side face 36. The outline of the punch shoulder 37 is in the shape of a circular arc. The punch shoulder 37 curves along the extending direction of the punch 34 (along the longitudinal direction of the reinforcing member) toward the top face 35. Accordingly, the edge portion of the reinforcing member to be produced curves inward (toward the top board).

Figure 10:
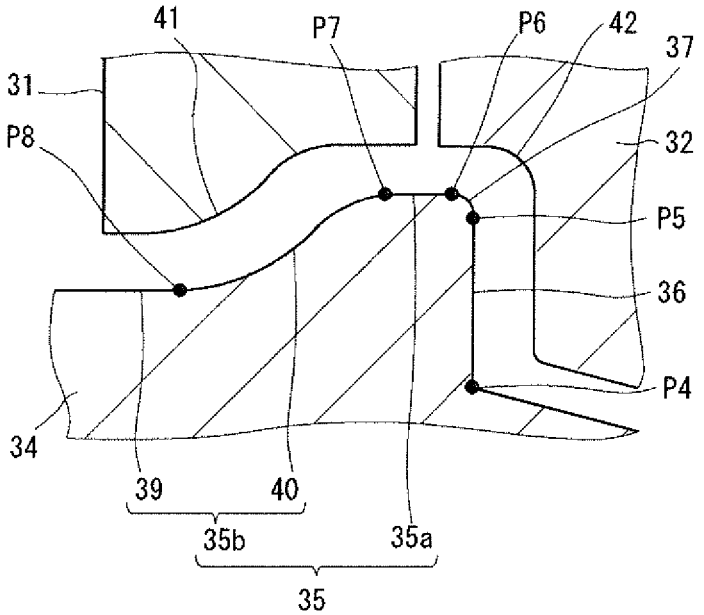
FIG. 10 is an enlarged view of a part of the pressing machine shown in FIG. 9 around a punch shoulder.

FIG. 10 is an enlarged view of a part of the pressing machine shown in FIG. 9 around the punch shoulder. The side face 36 is a portion from a border P4 to a border P5. The border P4 is the lower edge of the side face 36 of the punch 34. The border P5 is the border between the side face 36 and the punch shoulder 37 of the punch 34. The border P5 is an edge of the punch shoulder 37. The border P6 is the border between the punch shoulder 37 and the top face 35. The punch shoulder 37 is a portion from the border P5 to the border P6. The border P5 and the border P6 define the outline of the punch shoulder 37. The top face 35 is a portion extending from the border P6 toward the third die (leftward in FIG. 10).

The top face 35 includes a flat portion 35*a* and a concavity 35*b*. The flat portion 35*a* is a portion between the border P6 and a border P7. The border P7 is the border between the flat portion 35*a* and the concavity 35*b*. The concavity 35*b* includes an inner wall 40 and a bottom face 39. The inner wall 40 is a portion between the border P7 and a border P8. Both edges of the inner wall 40 are in the shape of a circular arc. Thus, the borders P7 and P8 are edges of the inner wall 40. The border P8 is the border between the inner wall 40 and the bottom face 39. The bottom face 39 of the concavity 35*b* is a portion from the border P8 to the end of the punch 34.

In the pressing direction, the first die 31 faces at least the inner wall 40 of the concavity 35*b* of the punch 34. The first die 31 includes a projecting portion 41 corresponding to the inner wall 40 of the concavity 35*b* of the punch 34. Accordingly, the projecting portion 41 of the first die 31 has a shape which is concavo-convexly reversed to the shape of the concavity 35*b* of the punch 34. Thus, the first die 31 has a shape corresponding to at least the inner wall &8 (see FIG. 1) of the reinforcing member. The first die 31 also may face the flat portion 35*a* of the punch 34 in the pressing direction. The first die 31 does not face the punch shoulder 37 in the pressing direction. As described above, if the first die 31 faces the punch shoulder 37, the edge of the first die 31 will be sharp and will easily get broken. Also, the first die 31 may face the bottom face 39 of the punch 34 in the pressing direction. However, the first die 31 does not face the entire bottom face 39 of the punch 34 in the pressing direction. This is to ensure the blank S to be pressed by the third die 33.

The second die 32 is the same as the second 12 (see FIG. 4) of the first embodiment. Therefore, the second die 32 is located adjacent to the first die 31. The second die 32 has a recess 42 having a shape corresponding to the shape of the punch shoulder 37 and the side face 36 of the punch 34. Accordingly, the shape of the recess 42 of the second die 32 is concavo-convexly reversed to the shape of the punch shoulder 37 and the side face 36 of the punch 34. Thus, the second die 32 has a shape corresponding to at least the vertical wall 5 and the edge portion 6 (see FIG. 1) of the reinforcing member.

As shown in FIG. 9, the third die 33 is located adjacent to the first die 31. The third die 33 is positioned across from the second die 32 with the first die 31 in between. The third die 33 has a shape corresponding to at least a part of the bottom face of the concavity of the reinforcing member. The third die 33 faces the bottom face 39 of the punch 34. There are no particular limits to what portion of the bottom face 39 of the punch 34 the third die 33 faces. It is determined appropriately in accordance with the size of the first die 31 what portion of the bottom face 39 of the punch 34 the third die 33 faces. However, the third die 33 does not face the inner wall 40 of the punch 34 in the pressing direction. As described above, the inner wall of the punch 34 faces the first die 31 in the pressing direction. Thereby, the first die 31 permits the material of the blank to flow in during press forming.

The first die 31, the second die 32 and the third die 33 are located under an upper holder 43. A first pressing member 61, a second pressing member 62 and a third pressing member 63 are disposed between the first die 31 and the upper holder 43, between the second die 32 and the upper holder 43, and between the third die 33 and the upper holder 43, respectively. The upper holder 43 is fastened to a slide (not shown). The punch 34 is fixed to a lower holder 44. The lower holder 44 is fastened to a bolster plate (not shown) as in the first embodiment.

While no load is applied to the first pressing member 61, the second pressing member 62 and the third pressing member 63 (while the upper holder 43 is in an upper position), an edge 73 of the third die 33 which is adjacent to the first die 31 and near the punch 34 is positioned lower than the edge 72 of the second die 32 which is extended from the recess 42 and is adjacent to the first die 31. The level difference between the edges is greater than the level difference between the flat portion 35*a* and the bottom face 39 of the punch 34. While no load is applied to the first pressing member 61, the second pressing member 62 and the third pressing member 63 (while the upper holder 43 is in the upper position), the edge 72 of the second die 32 which is extended from the recess 42 and is adjacent to the first die 31 is positioned lower than the edge 71 of the first die 31 which is extended from the projecting portion 41 and is adjacent to the second die 32. Accordingly, as the upper holder 43 is moving down, the third die 33, the second die 32 and the first die 31 reach their respective bottom dead points for forming in this order.

The pressing machine 30 is not limited to the machine shown in FIG. 9. Another modification will be described.

Figure 15:
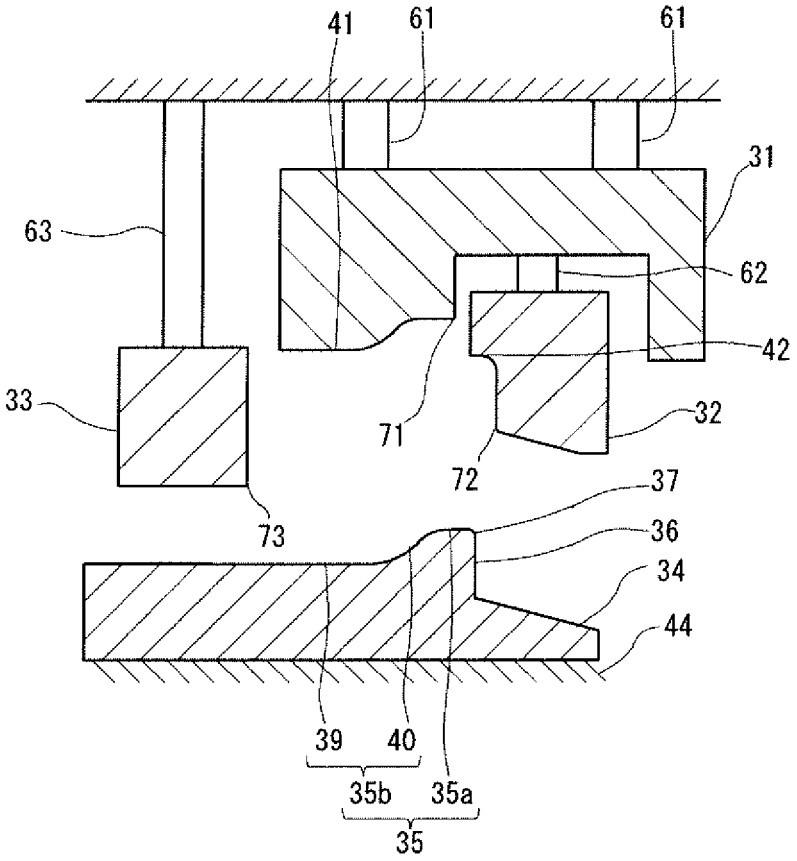
FIG. 15 is a sectional view of another modification of the pressing machine according to the third embodiment.

FIG. 15 is a sectional view of a modification of the pressing machine according to the third embodiment. This modified pressing machine differs from the machine shown in FIG. 9 in the following points. In this modification, the first die 31 extends over the second die 32, and the second pressing member 62 above the second die 32 is located between the first die 31 and the second die 32. The second die 32 is located adjacent to the edge 71 of the first die 31 which is extended from the projecting portion 41, and located lower than the first die 41. In this modification also, while no load is applied to the first pressing member 61, the second pressing member 62 and the third pressing member 63 (while the upper holder 43 is in the upper position), the edge 73 of the third die 33 which is adjacent to the first die 31 and is near the punch 34 is positioned lower than the edge 72 of the second die 32 which is extended from the recess 42 and is adjacent to the first die 31. The level difference between the edges is greater than the level difference between the flat portion 35*a* and the bottom face 39 of the punch 34. While no load is applied to the first pressing member 61, the second pressing member 62 and the third pressing member 63 (while the upper holder 43 is in the upper position), the edge 72 of the second die 32 which is extended from the recess 42 and is adjacent to the first die 31 is positioned lower than the edge 71 of the first die 31 which is extended from the projecting portion 41 and is adjacent to the second die 32. Accordingly, as the upper holder 43 is moving down, the third die 33, the second die 32 and the first die 31 reach their respective bottom dead points for forming in this order.

Figure 16:
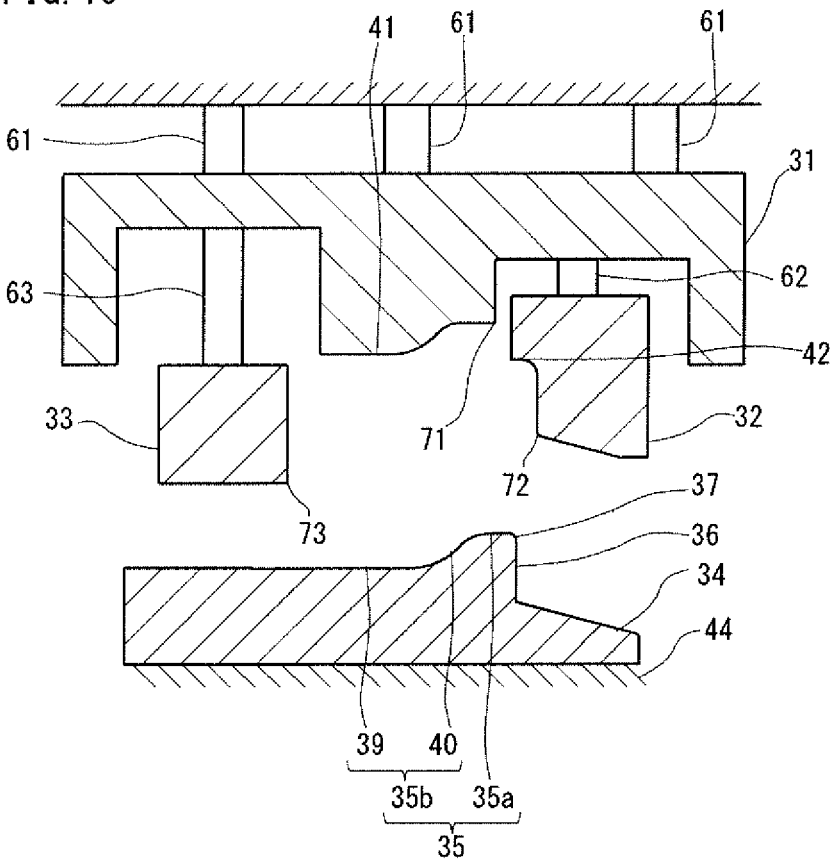
FIG. 16 is a sectional view of still another modification of the pressing machine according to the third embodiment.

FIG. 16 is a sectional view of another modification of the pressing machine according to the third embodiment. In the modification, as shown in FIG. 16, the first die 31 may be extended to lie over the third die 33, and the third pressing member 63 above the third die 33 may be located between the first die 31 and the third die 33.

Still another modification will be described. The pressing machine 30 is not limited to the machine shown in FIG. 9.

Figure 13:
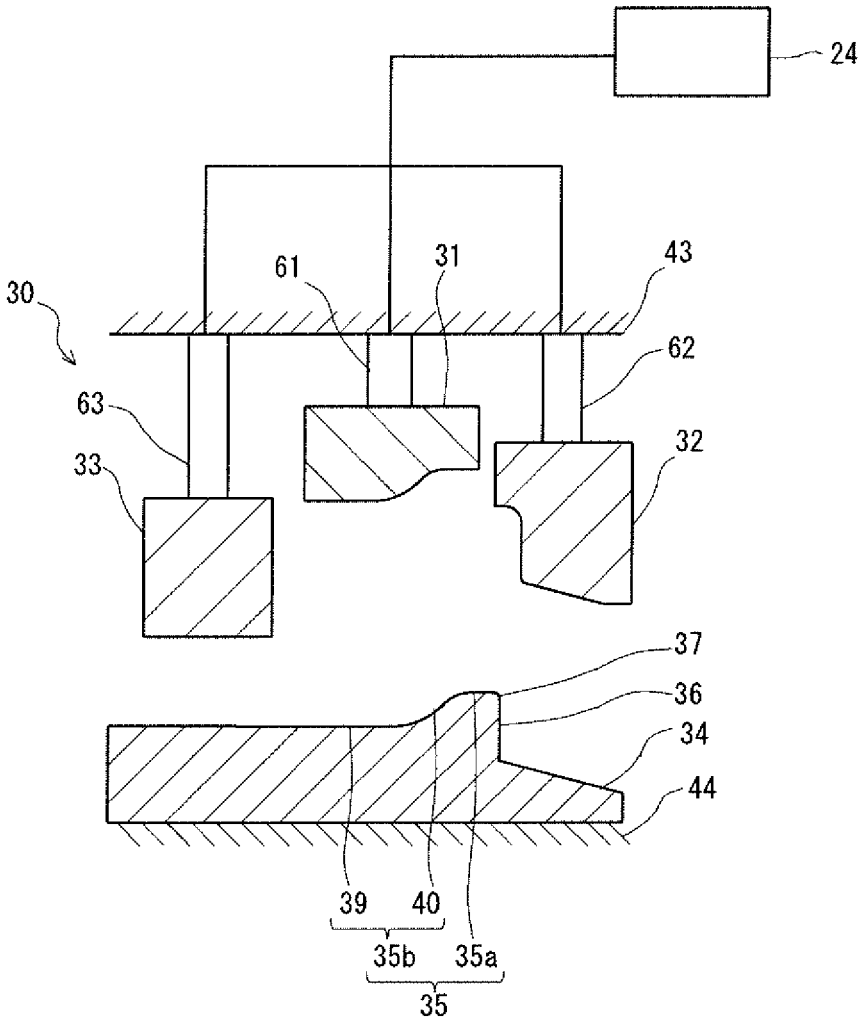
FIG. 13 is a sectional view of a modification of the pressing machine according to the third embodiment.

FIG. 13 is a sectional view of a modification of the pressing machine according to the third embodiment. For example, the first die 31, the second die 32 and the third die 33 may be fastened to separately movable slides. In this case, the separately movable slides are the first pressing member 61, the second pressing member 62 and the third pressing member 63. The pressing machine 30 further includes a control unit 24. The control unit 24 controls motions of the first die 31, the second die 32 and the third die 33. The control unit 24 sends out commands to cause the third die 33, the second die 32 and the first die 31 to reach their respective bottom dead points for forming in this order. The first pressing member 61, the second pressing member 62 and the third pressing member 63 receive commands from the control unit 24 and move the first die, the second die and the third die.

[Manufacturing Method]

A method for manufacturing a reinforcing member by using the pressing machine according to the third embodiment will be described. The manufacturing method according to the third embodiment is based on the manufacturing method according to the first embodiment. The manufacturing method according to the third embodiment differs from the manufacturing method according to the first embodiment in the following point. In the manufacturing method according to the third embodiment, while a blank is pressed by the third die in the first step and the second step, press forming is carried out by the first die and the second die. The preparation step in the manufacturing method according to the third embodiment is the same as that in the manufacturing method according to the first embodiment, and the preparation step according to the third embodiment will not be described. The first step and the second step in the manufacturing method according to the third embodiment will be described below.

[First Step and Second Step]

The manufacturing method according to the third embodiment is to produce a reinforcing member which has a vertical wall only on one side when it is seen in a sectional view. Accordingly, the second die to form a vertical wall is disposed only on one side. When press forming is carried out by use of such a pressing machine, a blank is not held when the second die is to press the blank. Therefore, the blank may move during the press forming by the second die, and the press forming may not be carried out steadily. Then, in the third embodiment, the third die is added to the pressing machine according to the first embodiment. While the blank is held by the third die, the blank is pressed by the first die and the second die, as in the case of the first embodiment, to produce a reinforcing member. Thereby, even in producing a reinforcing member with a vertical wall only on one side, steady press forming can be carried out. Also, the first die can permit the material of the blank to flow in, which suppresses a decrease of the produced reinforcing member in fatigue resistance.

Figure 11A:
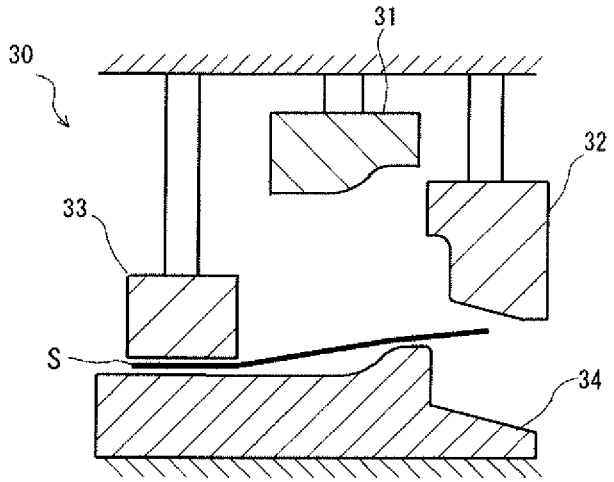
FIG. 11A is a view showing a stage before press forming in a first step and a second step according to a third embodiment.
Figure 11B:
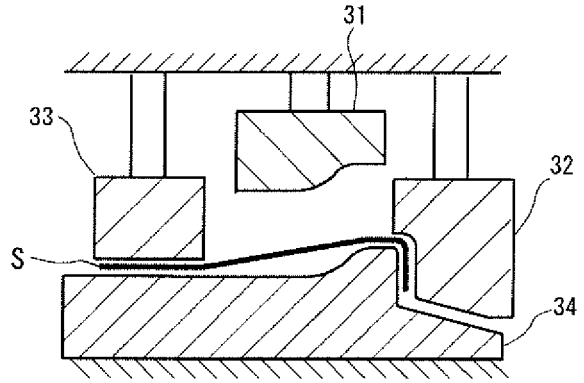
FIG. 11B is a view showing a stage during press forming in the first step and the second step according to the third embodiment.
Figure 11C:
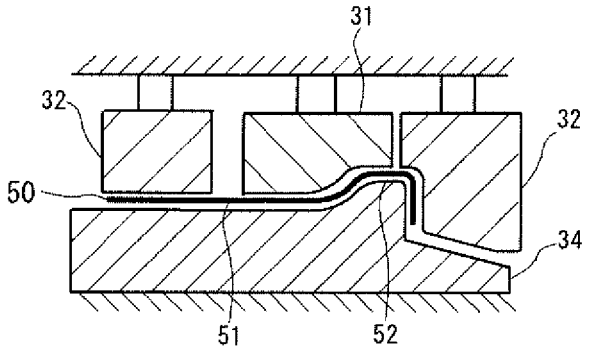
FIG. 11C is a view showing a stage on completion of press forming in the first step and the second step according to the third embodiment.

FIGS. 11A to 11C are sectional views showing an example of the first step and second step of the manufacturing method according to the third embodiment. FIG. 11A shows a stage before press forming in the first step and the second step of the manufacturing method according to the third embodiment. FIG. 11B shows a stage during press forming in the first step and the second step of the manufacturing method according to the third embodiment. FIG. 11C shows a stage on completion of press forming in the first step and the second step of the manufacturing method according to the third embodiment.

After a blank S is set in a specified position of the pressing machine 30, the slide (not shown) moves down, and the blank S is first pinched between the third die 33 and the punch 34 as shown in FIG. 11A. In this regard, the blank S may be formed by the pinching between the third die 33 and the punch 34.

As shown in FIG. 11B, the blank S is press formed by the second die 32 and the punch 34 while being held by the third die 33. As in the first embodiment, the press forming of the blank S by the first die 31 has not been completed at the end of the press forming of the blank S by the second die 32. The slide moves further down from this state, and at the end, a concavity 51 of the reinforcing member 50 is formed by the first die 31 (see FIG. 11C). With the forming of the concavity 51, a brim 52 is also formed. In the third embodiment, therefore, as in the first embodiment, the springback amount of the vertical wall after mold release decreases, and accordingly, a decrease of the reinforcing member 50 in fatigue resistance can be suppressed.

The manufacturing method according to the third embodiment for manufacturing a reinforcing member for a lower arm has been described above.

Preferred examples of pressing machines according to the first to the third embodiments will be described below.

[Radius of Curvature of Punch Shoulder]

In a section of the punch shoulder 16, the radius of curvature of the punch shoulder 16 is preferably not less than 2 mm and not more than 10 mm. Here, a section of the punch shoulder 16 means a section of the punch shoulder 16 along a line perpendicular to the extending direction of the punch shoulder 16 (the extending direction of the lower arm), as shown in FIG. 4. If the radius of curvature of the punch shoulder 16 is less than 2 mm, the vertical wall to be press formed by the second die 12 will curve sharply. In this case, accordingly, during the forming of the concavity of the lower arm by the first die 11, the material will not flow from the vertical wall into the concavity easily. If the radius of curvature of the punch shoulder 16 is more than 10 mm, the radius of curvature of the edge portion of the formed lower arm will be large. In this case, accordingly, the second moment of area of the lower arm will be small, and the strength of the lower arm 1 will be insufficient.

[Maximum Curvature Radius of Punch Shoulder]

As shown in FIG. 1, the vertical wall 5 of the lower arm 1 according to the embodiment curves inward. As mentioned above, the vertical wall 5 is formed by stretch flanging. The edge portion 6 connecting to the vertical wall 5 curves. The smaller the curvature radius of the edge portion 6, the greater is the residual tensile stress on the back side of the edge portion 6 of the formed lower arm 1, and accordingly, the lower is the fatigue resistance of the lower arm 1.

The edge portion 6 is formed by the punch shoulder 16 of the punch 13 and the second die 12. The punch shoulder 16 of the punch 13 curves inward (toward the top face) as the edge portion 6 does. The maximum curvature radius of the curving punch shoulder 16 is preferably not less than 100 mm and not more than 250 mm. The reasons are as follows. If the maximum curvature radius of the punch shoulder 16 is less than 100 mm, the edge portion 6 and the vertical wall 5 to be formed will curve inward sharply, and the residual tensile stress in a direction along the edge portion 6 will be large. If the maximum curvature radius of the punch shoulder 16 is more than 250 mm, the space for suspension members of an automobile is restricted, and the flexibility of design will be low. In a case where the curvature radius of the punch shoulder 16 varies according to position, the maximum curvature radius of the punch shoulder 16 means the greatest value of the curvature radii.

[Width of Portion Between Punch Shoulder and Punch Concavity]

The width of a portion between the punch shoulder and the concavity of the punch will hereinafter be described by using the pressing machine according to the third embodiment shown in FIG. 10 as an example. The following limit to the width of the portion between the punch shoulder 37 and the concavity 35*b* of the punch 34 applies to the pressing machines according to the first and second embodiments.

The width of the portion between the punch shoulder 37 and the concavity 35*b* of the punch 34 is preferably not more than 15 mm. The width of the portion between the punch shoulder 37 and the concavity 35*b* of the punch 34 means the distance between the border P6 and the border P7 as shown in FIG. 10. If the width of the portion between the punch shoulder 37 and the concavity 35*b* of the punch 34 is more than 15 mm, the frictional resistance between the second die 32 and the punch 34 will be great. In this case, accordingly, during forming of a concavity of a press-formed product (not shown) by the first die 31, the material will not flow into the concavity of the press-formed product easily. No particular lower limit is set to the width of the portion between the punch shoulder 37 and the concavity 35*b* of the punch 34. The width of the portion between the punch shoulder 37 and the concavity 35*b* of the punch 34 may be zero. In this case, the punch shoulder 37 and the concavity 35*b* of the punch 34 connect to each other smoothly.

[Depth of Punch Concavity]

The depth of the concavity of the punch will hereinafter be described by using the pressing machine according to the third embodiment shown in FIG. 10 as an example. The following limits to the depth of the concavity 35*b* of the punch 34 apply to the pressing machines according to the first and second embodiments.

The depth of the concavity 35*b* of the punch 34 is preferably not less than 3 mm and not more than 20 mm. The depth of the concavity 35*b* of the punch 34 means the distance between the flat portion 35*a* and the bottom surface 39 of the concavity 35*b* of the punch 34 shown in FIG. 10. If the depth of the concavity 35*b* of the punch 34 is less than 3 mm, the amount of material flowing into the concavity during forming of a concavity of a press-formed product (not shown) by the first die 31 will not be sufficient. If the depth of the concavity 35*b* of the punch 34 is more than 20 mm, the amount of forming performed by the first die will be large, and the blank will get broken easily.

Preferred examples of press-formed products according to the first to third embodiments will be described below.

[Radius of Curvature of Edge Portion]

As shown in FIG. 6, the outline of the edge portion 6 of the lower arm is in the shape of a circular arc. In a section of the edge portion 6, the radius of curvature of the edge portion 6 is preferably not less than 2 mm and not more than 10 mm. A section of the edge portion 6 is a section of the edge portion 6 along a line perpendicular to the extending direction of the lower arm 1. If the radius of curvature of the edge portion 6 is less than 2 mm, the vertical wall 5 will curve sharply, and accordingly, the material will not flow from the vertical wall 5 into the concavity 8 easily. If the radius of curvature of the edge portion 6 is more than 10 mm, the second moment of area of the lower arm will be small, and the strength of the lower arm 1 will be insufficient.

[Height of Vertical Wall]

The height h of the vertical wall 5 (see FIG. 6) is preferably not less than 17 mm and not more than 35 mm. The height h of the vertical wall 5 is the distance between the brim 7 and the edge of the vertical wall 5. If the height of the vertical wall 5 is less than 17 mm, the second moment of area of the lower arm 1 will be small, and the strength of the lower arm 1 will be insufficient. The height of the vertical wall 5 is more than 35 mm, the frictional resistance between the second die 12 and the punch 13 will be great, and the material will not flow from the vertical wall 5 into the concavity 8 easily during forming of the concavity 8 by the first die 11.

[Maximum Curvature Radius of Edge Portion]

As shown in FIG. 1, the edge portion 6 of the lower arm 1 according to the embodiment curves inward. The smaller the radius of curvature of the edge portion 6, the greater is the residual tensile stress on the back side of the edge portion 6 of the formed lower arm 1, and accordingly, the lower is the fatigue resistance of the lower arm 1. The maximum curvature radius of the curving edge portion 6 is preferably not less than 100 mm and not more than 250 mm. The reasons are as follows. If the maximum curvature radius of the edge portion 6 is less than 100 mm, the edge portion 6 will curve inward sharply, and the residual tensile stress in a direction along the edge portion 6 will be large. If the maximum radius of curvature of the edge portion 6 is more than 250 mm, the space for suspension members of an automobile is restricted, and the flexibility of design will be low. In a case where the curvature radius of the edge portion 6 varies according to position, the maximum curvature radius of the edge portion 6 means the greatest value of the curvature radii.

[Width of Brim]

The width W of the brim 7 is preferably not more than 15 mm. As shown in FIG. 6, the width W of the brim 7 is the distance between the border P2 and the border P3. If the width W of the brim 7 is greater than 15 mm, the frictional resistance between the second die 12 and the punch 13 will be great. Accordingly, the material will not flow into the concavity 8 during forming of the concavity 8 by the first die 11. No particular lower limit is set to the width W of the brim 7. The width W of the brim 7 may be zero. In this case, the edge portion 6 and the peripheral portion 8*a* of the concavity 8 connect to each other smoothly.

[Depth of Concavity]

The depth D of the concavity 8 is preferably not less than 3 mm and not more than 20 mm. The depth D of the concavity 8 means the distance between the brim 7 and the bottom face 8*b* of the concavity 8 as shown in FIG. 6. If the depth D of the concavity 8 is less than 3 mm, the amount of material flowing into the concavity 8 during forming of the concavity 8 by the first die 11 will not be sufficient. If the depth D of the concavity 8 is more than 20 mm, the amount of forming performed by the first die 11 will be large, and the blank S will get broken easily.

The above description is of a case where the press-formed product to be produced by the method according to the embodiment is an automobile lower arm. However, the press-formed product is not limited to a lower arm. The manufacturing method according to the embodiment is useful for production of a press-formed product which has a concavity and an inward curving vertical wall and is required to be excellent in fatigue resistance. Such a press-formed product is, for example, an undercarriage part of an automobile. An undercarriage part indicates an upper arm or the like as well as a lower arm.

The pressing machine 10 according to the embodiment includes the first die 11 and the second die 12 as upper dies, and includes the punch 13 as a lower die. However, no particular limits are set to the die arrangement. In the pressing machine 10, the first die 11, the second die 12 and the punch 13 may be arranged upside down. In sum, it is only necessary that the first die 11 and the second die 12 are configured to move relative to the punch 13.

EXAMPLES

In order to confirm the effects of the invention, an analysis was performed in the FEM as described below. In the FEM analysis, it was assumed that a press-formed product usable as a lower arm was produced by press forming of a material metal plate. As an inventive example, the manufacturing method according to the second embodiment shown in FIGS. 7A to 7C was assumed to be used. As a comparative example, the conventional manufacturing method shown in FIGS. 2A to 2C was assumed to be used. Thus, the inventive example differed from the comparative example in the following points: forming by the first die 11 ended after forming by the second die 12 ended; and the blank S used in the inventive example had a depression 9*a*, while the blank S used in the comparative example had a concavity 106 which was formed beforehand. There were no other differences between the inventive example and the comparative example. Press-formed products produced by these methods were evaluated in stress on the edge portion of a press-formed product when the upper die was in the bottom dead point for forming and in residual stress on the press-formed product after mold release.

By the manufacturing methods according to the inventive example and the comparative example, press-formed products having the shape shown in FIG. 1 were produced. The material metal plates were steel plates which had a board thickness of 2.6 mm and had a tensile strength of 980 MPa. In each of the produced press-formed products, the radius of curvature of the edge portion was 8 mm, and the height of the vertical wall was 23 mm. In each of the produced press-formed products, the maximum curvature radius of the edge portion was 160 mm.

[Analysis Results]

In the inventive example, the stress on the edge portion after mold release was a tensile stress, and the maximum value thereof was 50 MPa. In the comparative example, the stress on the edge portion after mold release was a tensile stress, and the maximum value thereof was 340 MPa.

These results show that the manufacturing method according to the embodiment can suppress residual stress on the produced press-formed product and thereby can suppress a decrease of the press-formed product in fatigue resistance.

INDUSTRIAL APPLICABILITY

The manufacturing method of a press-formed product according to the present invention is useful for production of a press-formed product having a shape like an automobile lower arm. The manufacturing method according to the present invention is useful especially for production of a lower arm which is required to be excellent in fatigue strength.

LIST OF REFERENCE SYMBOLS

1: press-formed product (lower arm)
2: body
3: projection
5: vertical wall
6: edge portion
7: brim
8: concavity
9*a*: depression
9*b*: protuberance
10, 30: pressing machine
11, 31: first die
12, 32: second die
33: third die
13, 34: punch
13*a*: bottom face of punch
14: top face of punch
15: side face of punch
16: punch shoulder
17: concavity of punch
18: convexity of first die
19: recess of second die
20: upper holder
21: lower holder
61: first pressing member
62: second pressing member
63: third pressing member
B: end portion to be fastened to vehicle body
WH: end portion to be fastened to wheel
D: depth of concavity
h: height of vertical wall
W: width of brim
S: blank
SP: space between blank and punch

The invention claimed is:

1. A pressing machine comprising:

a punch including a top face, a side face, and a punch shoulder connecting the top face and the side face, the punch shoulder curving along an extending direction of the punch and toward the top face, the top face including a concavity with a bottom face and an inner wall;

a first die located to face at least the inner wall of the concavity of the punch, the first die including a projecting portion having a shape corresponding to a shape of the inner wall of the concavity;

a second die located adjacent to the first die, the second die including a recess having a shape corresponding to a shape of the punch shoulder and the side face of the punch;

a third die located adjacent to the first die to be positioned across from the second die with the first die in between;

an upper holder located above the first die, the second die and the third die;

a first pressing member located between the upper holder and the first die;

a second pressing member located between the upper holder and the second die; and a third pressing member located between the upper holder and the third die;

wherein:

an edge of the third die which is adjacent to the first die and near the punch is positioned lower than an edge of the second die which is extended from the recess and is adjacent to the first die; and the edge of the second die which is extended from the recess and is adjacent to the first die is positioned lower than an edge of the first die which is extended from the projecting portion and is adjacent to the second die.

2. The pressing machine according to claim 1, wherein a part of the first die is positioned between the upper holder and at least one of the second pressing member and the third pressing member.

3. A pressing machine comprising:

a punch including a top face, a side face, and a punch shoulder connecting the top face and the side face, the punch shoulder curving along an extending direction of the punch and toward the top face, the top face including a concavity with a bottom face and an inner wall;

a first die located to face at least the inner wall of the concavity of the punch, the first die including a projecting portion having a shape corresponding to a shape of the inner wall of the concavity;

a second die located adjacent to the first die, the second die including a recess having a shape corresponding to a shape of the punch shoulder and the side face of the punch;

a third die located adjacent to the first die to be positioned across from the second die with the first die in between; and a control unit controlling motions of the first die, the second die and the third die such that the third die reaches a bottom dead point for forming, next the second die reaches a bottom dead point for forming, and thereafter the first die reaches a bottom dead point for forming.

4. A method for manufacturing a press-formed product including a top board, a vertical wall, and an edge portion connecting the top board and the vertical wall, the edge portion and the vertical wall curving inward to the top board, the top board having a concavity, the method comprising:

press forming the concavity in a blank by using a punch having a shape corresponding to a shape of the entire press-formed product and a first die having a shape corresponding to at least a shape of the concavity; and press forming the vertical wall and the edge portion in the blank by using the punch and a second die which is located adjacent to the first die and has a shape corresponding to at least a shape of the vertical wall and the edge portion;

wherein the press forming of the concavity is completed after the press forming of the vertical wall and the edge portion is completed and the press-formed product is manufactured.

5. The method for manufacturing a press-formed product according to claim 4, wherein the blank has a depression in an area corresponding to the concavity, the depression being shallower than the concavity.

6. The method for manufacturing a press-formed product according to claim 4, wherein in a section of the edge portion, a radius of curvature of the edge portion is not less than 2 mm and not more than 10 mm.

7. The method for manufacturing a press-formed product according to claim 4, wherein a height of the vertical wall is not less than 17 mm and not more than 35 mm.

8. The method for manufacturing a press-formed product according to claim 4, wherein a maximum curvature radius of the edge portion and vertical wall curving inward to the top portion is not less than 100 mm and not more than 250 mm.

9. The method for manufacturing a press-formed product according to claim 4, wherein a width of a portion of the top board between the edge portion and the concavity is not more than 15 mm.

10. The method for manufacturing a press-formed product according to claim 4, wherein a depth of the concavity of the top board is not less than 3 mm and not more than 20 mm.

11. The method for manufacturing a press-formed product according to claim 4, wherein the press-formed product is an undercarriage part of an automobile.

12. A method for manufacturing a press-formed product including a top board, a vertical wall, and an edge portion connecting the top board and the vertical wall, the edge portion and the vertical wall curving inward to the top board, the top board having a concavity with a bottom face and an inner wall, the method comprising:

press forming at least the inner wall of the concavity in a blank by using a punch having a shape corresponding to a shape of the entire press-formed product and a first die having a shape corresponding to at least a shape of the inner wall of the concavity; and press forming the vertical wall and the edge portion in the blank by using the punch and a second die which is located adjacent to the first die and has a shape corresponding to at least a shape of the vertical wall and the edge portion;

wherein, during the press forming of the inner wall of the concavity, the vertical wall and the edge portion, the blank is pinched between the punch and a third die having a shape corresponding to at least a shape of a part of the bottom face of the concavity of the press-formed product, and the press forming of the inner wall of the concavity is completed after the press forming of the vertical wall and the edge portion is completed and the press-formed product is manufactured.

* * * * *